US009406495B2

(12) United States Patent
Jiang et al.

(10) Patent No.: US 9,406,495 B2
(45) Date of Patent: Aug. 2, 2016

(54) LINEAR ION BEAM BONDING APPARATUS AND ARRAY STRUCTURE THEREOF

(71) Applicant: SHIMADZU RESEARCH LABORATORY (SHANGHAI) CO. LTD., Shanghai (CN)

(72) Inventors: Gongyu Jiang, Shanghai (CN); Wenjian Sun, Shanghai (CN)

(73) Assignee: SHIMADZU RESEARCH LABORATORY (SHANGHAI) CO. LTD., Shanghai (CN)

( * ) Notice: Subject to any disclaimer, the term of this patent is extended or adjusted under 35 U.S.C. 154(b) by 102 days.

(21) Appl. No.: 14/389,642

(22) PCT Filed: Feb. 26, 2013

(86) PCT No.: PCT/CN2013/071877

§ 371 (c)(1),
(2) Date: Sep. 30, 2014

(87) PCT Pub. No.: WO2013/143369

PCT Pub. Date: Oct. 3, 2013

(65) Prior Publication Data

US 2015/0170898 A1 Jun. 18, 2015

(30) Foreign Application Priority Data

Mar. 30, 2012 (CN) ..... 2012 1 0090725

(51) Int. Cl.
*H01J 49/42* (2006.01)
*H01J 49/06* (2006.01)
*H01J 49/00* (2006.01)

(52) U.S. Cl.
CPC ..... *H01J 49/423* (2013.01); *H01J 49/0027* (2013.01); *H01J 49/063* (2013.01); *H01J 49/427* (2013.01); *H01J 49/4255* (2013.01)

(58) Field of Classification Search
CPC ..... H01J 49/423; H01J 49/422; H01J 49/063; H01J 49/4225
See application file for complete search history.

(56) References Cited

U.S. PATENT DOCUMENTS 5,783,824 A * 7/1998 Baba ..... H01J 49/423 250/281
6,730,904 B1 5/2004 Wells
6,911,650 B1 * 6/2005 Park ..... H01J 49/063 250/282

(Continued)

FOREIGN PATENT DOCUMENTS

CN 101369510 A 2/2009
CN 102067274 A 5/2011

OTHER PUBLICATIONS

State Intellectual Property Office of the P.R. China (ISR/CN), "International Search Report for PCT/CN2013/071877", China, Apr. 4, 2013.

*Primary Examiner* — Nicole Ippolito
*Assistant Examiner* — Sean Luck
(74) *Attorney, Agent, or Firm* — Tim Tingkang Xia, Esq.; Locke Lord LLP

(57) ABSTRACT

A linear ion beam bonding apparatus and an array structure thereof, comprising a pair of primary radiofrequency electrodes (501 and 502) extending along the axial direction and oppositely arranged on two sides of the central axis of the linear ion beam bonding apparatus. Section patterns on different section planes of each of the primary radiofrequency electrodes (501 and 502) and perpendicular to the central axis are all kept symmetric via a primary symmetric plane (506) of the central axis. Radiofrequency voltages attached to the primary radiofrequency electrodes (501 and 502) are of identical phases. An ion extraction groove (84) is arranged on at least one of the primary radiofrequency electrodes (501 and 502), while at least one pair of auxiliary electrodes (503 and 505) are arranged on two sides of the pair of primary radiofrequency electrodes (501 and 502). The auxiliary electrodes (503 and 505) are arranged in duality to the primary symmetric plane (506). At least one of the auxiliary electrodes (503 and 505) is provided with a finite number of symmetric planes (507), while a minimal angle greater than 0 degrees and less than 90 degrees is provided between each symmetric plane (507) and the symmetric plane (506) of the primary radiofrequency electrodes (501 and 502). By means of this, a quadrupole field component of an ion beam bonding radiofrequency electric field within the ion beam bonding apparatus is strengthened.

28 Claims, 26 Drawing Sheets

(56) References Cited

U.S. PATENT DOCUMENTS 7,807,963 B1 * 10/2010 Bier ..... H01J 49/422 250/281
2004/0195504 A1 * 10/2004 Senko ..... H01J 49/4225 250/291
2005/0279932 A1 * 12/2005 Wang ..... H01J 49/424 250/290
2006/0027745 A1 * 2/2006 Rebettge ..... H01J 9/14 250/292
2007/0029476 A1 * 2/2007 Senko ..... H01J 49/423 250/290
2007/0176094 A1 * 8/2007 Wells ..... H01J 49/4225 250/292
2008/0067363 A1 * 3/2008 Senko ..... H01J 49/4225 250/292
2009/0294641 A1 * 12/2009 Konicek ..... H01J 49/4225 250/281
2009/0321624 A1 * 12/2009 Fang ..... H01J 49/004 250/281

* cited by examiner

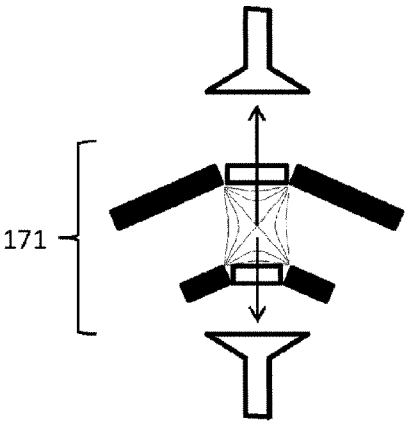
FIG. 17A
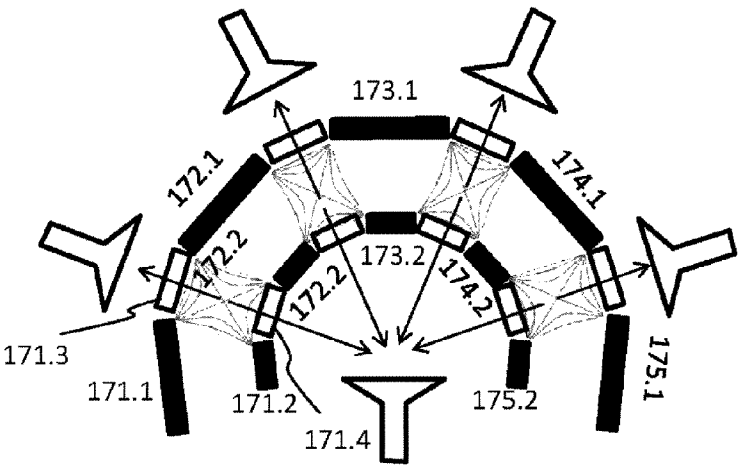
FIG. 17B
FIG. 17C
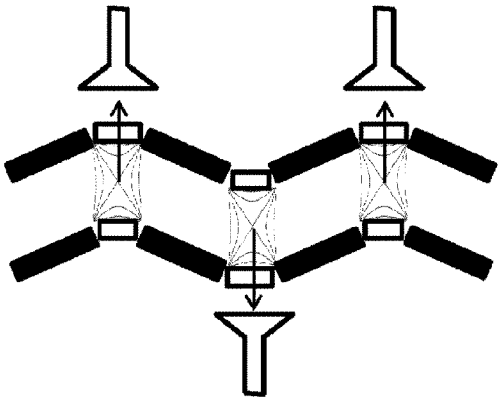
FIG. 17D
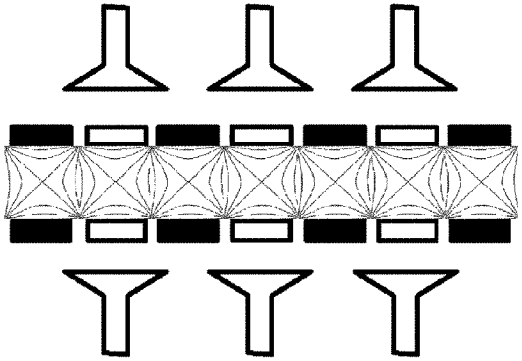
FIG. 17E

LINEAR ION BEAM BONDING APPARATUS AND ARRAY STRUCTURE THEREOF

BACKGROUND

1. Technical Field

The present invention relates to an ion storage apparatus capable of being used as a mass analyzer, and in particular, to a linear ion trapping apparatus capable of being used as a linear ion trap mass analyzer, and an array structure thereof.

2. Related Art

The mass spectrometry method is one of important analysis methods in the current mainstream fields of chemistry and life science. As a main analysis apparatus of the mass spectrometry method, a mass spectrometry instrument has been developed from a desktop type to a portable type, and even to a handheld type in recent years. The development of these new mobile devices has new requirements for miniaturization of major components of the mass spectrometry instrument, especially, the mass analyzer which functions as the core of the mass spectrometry instrument. The main objective is to ensure the basic analysis performance of the mass analyzer while ensuring the miniaturization and simplification of the structure.

Meanwhile, peripheral components such as a vacuum cavity and an acquisition system also limit the development of a portable mass spectrometry method. Among many types of mass analyzers, the ion trap mass analyzer has features such as a simple structure and a small volume. Moreover, this type of mass analyzer has a lowest requirement on the working vacuum degree among various types of mass analyzers at present. Therefore, in the application of the portable mass spectrometry instrument, instruments that use an ion trap mass analyzer as a core component plays a major role.

Both the ion trap mass analyzer and quadrupole rod mass analyzer that serves as a mainstream mass spectrometry instrument analyze ions under test based on the trajectory stability of different ions in a quadrupole RF(RF) trapping electric field. According to the spatial structure characteristic of quadrupole trapping electric fields, quadrupole trapping electric fields can be classified into axis-rotation symmetry three-dimensional quadrupole trapping electric fields and axis-translation symmetry two-dimensional quadrupole trapping electric fields. For an ion trap mass analyzer, these two types of internal electric field structures correspond to two basic types, that is, a three-dimensional ion trap and a linear ion trap. The ion trap structure that appeared first is the three-dimensional ion trap. Because of the structural characteristic of the electric field, the structure of this type of ion trap is mainly formed by rotating bodies, and therefore, lathe machining may be adopted for the machining technique of this type of ion trap. In lathe machining, the implementation of the three-dimensional structure only requires determination through the displacement of a lathe cutter on a two-dimensional r-z plane that passes through rotation axis z, that is, the surface of an ideal three-dimensional ion trap is made to be a hyperboloid of revolution; the three-dimensional structure can also be implemented by means of numerically-controlled lathe machining, and the machining precision can easily reach about 1 micron, which meets the current basic level of precision machining technique in China. At present, portable mass spectrometry instruments that use three-dimensional ion traps as mass analyzers are available in China.

However, before being analyzed, ions gather at the structural center of the three-dimensional ion trap in a dot-like distribution. Due to a space charge effect caused by a coulomb repulsive force between ions, the number of ions that can be stored by the three-dimensional ion trap is relatively limited. In addition, during ion analysis, the gathering of a large quantity of ions in the space changes a trapping electric field in the trap, and especially the gathering of many ions at the central part of the trap causes a greater impact on the potential distribution at the part. The upper limit of the number of ions stored in the three-dimensional ion trap generally does not exceed $10^6$ to $10^7$. When the number of stored ions exceeds $5\times10^4$ or the number of ions having the same mass-to-charge ratio exceeds $5\times10^3$, the mass resolution capability of the three-dimensional ion trap decreases by a great degree, which significantly affects the dynamic range of the ion trap as a mass analyzing tool. Moreover, introduction efficiency of ions having different mass-to-charge ratios has an obvious relationship with their introduction RF phases, which also causes an obvious decrease in sensitivity when an external ion source is used. In addition, when an abundance spectrum of broken ions is used as a qualitative standard, the analysis structure thereof becomes unreliable due to the mass discrimination process.

In the mid 90s, John E P Syka et al. from the US company Finnigan proposed a two-dimensional linear ion trap structure to solve the foregoing problem. In the linear ion trap, ions are gathered near a central axis by a substantial two-dimensional quadrupole RF electric field. Therefore, with the same space charge density, the linear ion trap can accommodate much more ions. The two-dimensional linear ion trap can store ions more than those the three-dimensional ion trap can store by at least one order of magnitude, and can avoid an obvious impact from the space charge effect. Documents in recent years indicated that when a linear ion trap stores millions of ions, the mass spectrum resolution capability is still not affected. In the original patent file U.S. Pat. No. 5,420,425, Syka et al. pointed out that it requires at least two electrodes extending in the axial direction to implement such a structure. However, due to the need for constructing an ideal two-dimensional quadrupole field, a common linear ion trap has a "quadrupole rod" symmetric structure as shown in FIG. 1. Voltages output by a group of RF power sources 101 and 102 that are inverted to each other are applied on an electrode pair 12 and 14 and an electrode pair 11 and 13, respectively, so as to provide a radial trapping RF quadrupole electric field; axial motion of trapped ions is trapped by a group of end electrodes 15 and 16. Similar to the quadrupole rod mass analyzer, this ion trap needs to be driven by a pair of RF voltage sources 101 and 102 having opposite phases. Different from the quadrupole rod mass analyzer, to confine axial motion of ions, this ion trap needs to be provided with end electrode structures 15 and 16 at the front end and rear end of the axis, so as to restrict ion motions by means of voltages on the electrode structures. As regards machining characteristics, electrodes of a linear ion trap need to be machined by using a high-precision curved-surface grinding machine, and the machining is more difficult than that of a three-dimensional ion trap. In addition, assembly of electrodes 11, 12, 13, and 14 cannot be implemented by using a rotary insulator structure of a three-dimensional ion trap; to assemble the electrodes, special-shaped fit slot and key structures need to be provided on an internal cylindrical surface that supports an insulator, which makes the overall process more complex and exceeds the general precision machining level in China.

An important characteristic of the quadrupole trapping electric field is that the distribution of its space potential is a quadratic function related to the distance to the center of the field. Therefore, during vibration of ions in the electric field, the restoring force on ions satisfies the Hooke's law, that is, the vibration demonstrates characteristics of simple harmonic vibration. Generally, the last step of the analysis process of the linear ion trap is that ions sequentially resonate with an auxiliary excitation voltage based on mass-to-charge ratios thereof, so as to leave the ion trap via the slot-shaped slit provided on the electrode of the linear ion trap and be detected by an ion detection apparatus to form a mass spectrum. Due to the existence of the slot-shaped slit, some of the space potential near the slit is missing as compared with the space potential formed by a complete hyperboloid electrode structure, that is, the field intensity near the ejection slot decreases. Such a change of the space electric field can be expressed by a series expansion $\Sigma A_n Re(x+yi)^n$ of the harmonic function of the space pseudo potential in the trap, where x is an ejection direction of ions, y is another direction orthogonal to the axis of the ion trap and the ejection direction, the term $A_2$ is a component of a quadrupole field, and the term $A_n$ is a component of a 2n-pole field. After an ejection slot structure 17 is added, ions in the ion ejection direction are affected by a negative RF high-order field generated by the loss of the RF electric field near the slot. The direct impact of the negative high-order field on ion motion is that, when the vibration amplitude of the ions increases, the resonance frequency of the ions has a red shift. As the mass scanning is generally performed from a low mass-to-charge ratio toward a high mass-to-charge ratio, the ion motion frequency has a blue shift along with the scanning process. The red shift process detunes the motion resonance of ions and therefore slows down the ejection process, causing a loss of the mass resolution.

To solve the foregoing problem, the inventor of the linear ion trap uses a so-called stretch structure, that is, the spacing between opposite electrodes in the ion ejection direction X is stretched outward symmetrically relative to the boundary of an ideal quadrupole field. This operation produces a positive-$A_n$ high-order electric field in the ion ejection direction. In a normal mass scanning process, if the motion frequency of ions of any specific mass-to-charge ratio has a constant blue shift process, that is, the motion frequency moves toward a higher frequency, the introduced positive high-order field can produce the following advantages on the mass analysis process of the ion trap: First, when ions resonate at the center of the trap, the resonance frequency has a blue shift because the vibration amplitude increases at the beginning of the resonance. After that, at an appropriate scanning speed, this blue shift effect is synchronized with a natural blue shift process of the ion motion frequency, so that ions always resonate effectively during the ejection motion frequency shift process and the ejection is accelerated, and therefore, the mass resolution of the linear ion trap when being used as a mass analyzer is ultimately improved. Generally, to achieve this objective, the stretching ratio of the electrode structure is set to about 3% to 10% of the radius of the original hyperboloid quadrupole field, where the field radius refers to a saddle point of the substantial quadrupole electric field, or a distance from the center of the electric field to the boundary electrode. It should be pointed out that, the finally commercialized linear ion trap solution designed by Jae Schwartz et al. has an x-y plane symmetric structure, and the probabilities of the ion ejection process in direction x are consistent. Therefore, in their commercial instruments, a pair of detector groups disposed on two sides of the linear ion trap is used to obtain a mass spectrum, so as to achieve maximum ion detection efficiency.

J. Hager from Sciex later provided another axial ejection linear ion trap technology. In this technology, ions mass-selectively leave the linear ion trap along an axial end direction of a substantial quadrupole rod structure. Because ions do not need to leave in the axial direction, it is unnecessary to provide slots on the rod electrode. Therefore, influence of an adverse factor such as a negative high-order field on the field pattern and device performance is avoided. In this technology, when the RF fringing field at an end of the substantial quadrupole rod structure and a DC (Direct Current) electrode 15 at the tail end of the quadrupole rod structure form a suppression electric field to eject and block ions, a combined effect changes from blocking to ejection as the radial coordinate of the ion increases, so as to achieve a mass selection process for ion ejection at the axial end. The advantage of this technology is that, this ion trap has no boundary electric field deficiency caused by the ejection slot, and therefore, can also be used as a common quadrupole mass filter; the disadvantage lies in that, ions are ejected at the axial fringing field only when moving to the tail end of the trap, and therefore, under the condition of a high scanning speed, ions in the trap can be ejected only when they are at the tail end of the trap; otherwise, ions are lost on the rod electrode, which causes the maximum scanning speed and ion detection efficiency thereof to be lower than those of the radial ejection process previously proposed by Schwartz et al.

Two existing basic linear ion trap working manners are described above. To simplify and improve the trap electrode structure, Professor Ouyang zheng and Professor R G. Cooks, et al. from Purdue University suggested, in the U.S. Pat. No. 6,838,666 pre-applied in 2003, replacing, in the substantial quadrupole rod structure of the original linear ion trap, the hyperboloid or rod electrode structure in the original commercial instrument with a planar electrode, so as to form a rectangular linear ion trap mass analyzer. The machining of the planar cylindrical electrode structure is relatively simple, and therefore, the mass analyzer is easier to implement under the same machining precision. The disadvantage of this structure lies in that, due to the ion trap cross section structure formed by the rectangular planar electrode, a lot of high-order field effect is introduced in the trap. In addition, the trap still uses the x-y plane symmetric structure, and uses a non-integer-divider dipole excitation auxiliary RF located at a non-linear resonance band of an octupole field. Therefore, according to the principle, ion ejection probabilities on ejection direction X of the mass analyzer are still almost the same, and to obtain the highest ion detection efficiency, a pair of detector groups disposed on two sides of the linear ion trap is still used to obtain a mass spectrum.

Further, as regards the electric field deficiency caused by the rectangular planar electrode structure as compared with the hyperboloid structure, in 2004, Ding Chuanfan et al. from Fudan University suggested, in Chinese Patent 200410024946.8, producing an ion trap by using a common printed circuit board, and adjusting the field pattern in the trap by applying RF voltages of different amplitudes on electrodes on the surface of the printed circuit board. Compared with the design of the rectangular ion trap, the printed circuit board ion trap has less high-order field component, and the quadrupole field component can reach 98%; under the same RF amplitude, the electric field intensity at the center of the trap is stronger than that of the rectangular ion trap, and therefore the trapped ion cloud has a better collision focus effect. The ion trap in this design is formed by four completely enclosed PCB flat electrodes and two thin electrode end caps having support legs.

To further simplify this design, Ding chuanfan et al. further proposed an ion storage and analysis apparatus array in Chinese Patent Application 200610001017.4 and US Patent Application 2009/0294655 A1, which includes two or more rows of electrode arrays disposed parallel to each other, where strip-shaped electrodes in the electrode array are parallel to each other. High-frequency voltages of different phases are applied on adjacent electrode strips, so that a high-frequency electric field is generated in a space between two electrode arrays, thereby forming multiple parallel linear ion trapping areas in this space. According to the result published by the inventors on the US journal Analytical Chemistry, the linear ion trap array still has the same mass resolution effect as that of a simply piled up rectangular ion trap array structure while saving surrounding electrodes in a direction (direction y) orthogonal to the ejection direction for each storage unit, and the structure is more compact. Moreover, as the electrode units in the direction orthogonal to the ejection direction are omitted, the possible mechanical structure error caused by these electrode units is also avoided.

Compared with a multi-layer concentric ion trap array structure previously proposed by others, for example, the cylindrical ion trap array proposed by the R G. Cooks Research Group from Purdue University in U.S. Pat. No. 6,762,406 and the later cylindrical ion trap array mass analyzer chip produced by Ramsy et al. based on the microelectromechanical systems (MEMS) technology, the device proposed by Ding chuanfan et al. has unique features, such as a large ion storage capacity, of a linear ion storage apparatus. It should be pointed out that, the area required by the detector of the ion trap array is similar to that of the previous ion trap array design, which is approximately the area occupied by the body of the ion trap array. This is adverse to the multi-channel synchronous detection of the ion trap array; that is, the analysis process in which multiple ion traps store ions separately, and then eject ions selectively based on a same mass axis; this is because a larger detector area means a greater collector capacitance during coulomb detection. Therefore, relative to the detector design for detecting a single ion trap, a transient voltage response caused by the ion current declines. Of course, this problem can be solved by setting multiple separate detector units. However, multiple detector units require cooperation of multiple sets of post-amplification and analog-to-digital circuits, which increases complexity during an actual application.

In the Chinese Patent Application 200910054963.9, Pan Xinyuan et al. from Fudan University further simplify the electrode structure of the above ion trap having a PCB electrode parallel array structure designed by Ding chuanfan et al. In the structure designed by Pan Xinyuan et al., two parallel PCB circuit boards are used, and each PCB circuit board has a RF planar electrode, where the two RF planar electrodes correspond to each other so as to form a substantial quadrupole trapping electric field in the space of the pair of RF planar electrodes. To improve the field pattern of the structure, two end cap electrodes on the same plane are designed on two sides of the plane of each RF electrode. The combined function of the two end cap electrodes on the same side substitutes the function of the electrode in direction Y that is orthogonal to the ejection direction of the original "substantial quadrupole rod" structure. However, the mass resolution performance of such a design result is unsatisfactory; it can be seen from the spectrogram of an electron bombardment ionization source about perfluorotributylamine, this structure only obtains unit mass resolution in a mass range of less than 200 Thomson.

The above designs of the linear ion trapping apparatus used as the mass analyzer are all established based on X-Y bisymmetric geometric structures, and in these structures, the mass analyzer has the same ion ejection probability at two sides along the ejection direction x. To improve the ejection characteristic of the substantial quadrupole rod linear ion trapping apparatus, Franzen et al. proposed a substantial quadrupole rod ion trap in the U.S. Pat. No. 6,831,275, and in the ion ejection direction, asymmetric high-order multi-pole field component additions such as a hexapole field and a decapole field are obtained by modifying the structure or voltage of the original quadrupole field, and by using the characteristic that the non-linear resonance thereof is asymmetric at the positive part and negative part in direction x, the ion mass selectivity and ejection efficiency at the axial end are improved. These characteristics are mentioned again by DJ Douglas et al. in the U.S. Pat. No. 7,141,789, and it is pointed out that, with 1% to 10% of the hexapole field addition, ions can be selectively lost on the rod electrode by means of asymmetric non-linear resonance in direction x, so as to improve the ion selectivity of the axial end ejection. However, these in the prior art all relate to the substantial quadrupole rod structure only, and setting of the orientation characteristic of ion ejection during a radial mass-selective ejection process of ions is not discussed.

Gregory J. Wells from Varian provides another method in the U.S. Pat. No. 7,034,293, in which the ion trapping center of the trap is deviated from its geometric center by changing the DC voltage configuration applied on the substantial quadrupole rod structure, so as to mitigate the asymmetry of the radial ejection of the ion trap. However, according to the fundamental quadrupole trapping apparatus theory, after a DC bias is applied, a certain quadrupole DC electric field is applied on the cross section of the ion trap, which causes a high mass loss phenomenon to result in mass discrimination when ions are introduced, and affects the full-mass scanning performance.

Li Ding et al. proposed a field adjustment electrode disposed outside an ion trapping apparatus in Chinese Patent Application 200910253112.7, so as to improve the ejection direction selectivity of this type of apparatuses. This method adjusts the ejection characteristic of ions by using a DC bias. In this solution, the electrode is located on an external side of the trapping apparatus, and therefore, the voltage change of the electrode has a smaller effect on the center of the trapping apparatus. Compared with the solution in the patent of Varian, this solution significantly mitigates the problems such as mass discrimination. However, in the embodiment of this patent application, only a linear ion trap system having a common substantial quadrupole rod structure is described.

SUMMARY

One of the technical problems to be solved by the present invention is to provide a simplified linear ion trapping apparatus, so as to solve problems that in a conventional substantial quadrupole rod linear ion trap, an assembly structure is complex and insulating positioning pieces are difficult to machine, and moreover, provide a desirable internally compensated RF electric field, so as to improve a mass resolution capability when the apparatus is used as a mass analyzer.

One aspect of the present invention provides a linear ion trapping apparatus, including a pair of main RF electrodes that are oppositely disposed on two sides of a central axis of the linear ion trapping apparatus and extend along an axial direction, an ion ejection slot being provided on at least one main RF electrode. Cross section patterns, on all section planes perpendicular to the central axis, of each main RF electrode of the pair of main RF electrodes are symmetrical about a main symmetry plane that passes through the central axis, where phases of RF voltages applied on the pair of main RF electrodes are the same. The apparatus further includes at least one auxiliary electrode pair located on two sides of the pair of main RF electrodes and disposed as duals with the main symmetry plane, where at least one auxiliary electrode has a finite number of symmetry planes, and a minimum included angle greater than 0 degree and less than 90 degrees exists among all included angles between the symmetry planes and a symmetry plane of the pair of main RF electrodes.

In an embodiment of the present invention, the linear ion trapping apparatus includes two auxiliary electrode pairs disposed as duals with the main symmetry plane.

In an embodiment of the present invention, the central axis is a curve in the main symmetry plane of the pair of main RF electrodes.

In an embodiment of the present invention, the ion ejection slot is formed by a gap between components of the pair of main RF electrodes symmetrical about the main symmetry plane.

In an embodiment of the present invention, the linear ion trapping apparatus is symmetrical about a plane that passes through the central axis and is perpendicular to the main symmetry plane.

In an embodiment of the present invention, the linear ion trapping apparatus has no other symmetry planes in a direction perpendicular to the main symmetry plane.

In an embodiment of the present invention, a transient resting potential distribution of the linear ion trapping apparatus on a cross section perpendicular to the central axis has asymmetric components dominated by a hexapole field in series expansion terms of a harmonic function with an electric field saddle point as a center, where an absolute value of a component factor ratio of the hexapole field to a quadrupole field is between 0.5% and 10%.

In an embodiment of the present invention, an electric field saddle point center of the linear ion trapping apparatus is deviated relative to a middle position of the pair of main RF electrodes toward one side, where the deviation accounts for 0.5% to 20% of a field radius of the ion trapping apparatus.

In an embodiment of the present invention, the deviation accounts for 0.5% to 10% of the field radius of the ion trapping apparatus.

In an embodiment of the present invention, the linear ion trapping apparatus further includes two end electrode structures used for reflecting ions, and the two end electrode structures are disposed at two ends of the linear ion trapping apparatus along the central axis.

In an embodiment of the present invention, at least one of the main RF electrodes or the auxiliary electrodes has a planar electrode structure, or a thin-layer electrode structure attached on an insulator plane.

In an embodiment of the present invention, in the even-numbered pairs of auxiliary electrodes, a structure of each auxiliary electrode is the same as that of a main RF electrode on the same side of the central axis.

In an embodiment of the present invention, the linear ion trapping apparatus further includes a working power supply and an adjustment apparatus. The adjustment apparatus is used to adjust an amplitude ratio of RF voltages or bias DCs applied between the pair of main RF electrodes and the auxiliary electrode, and change a dominant ejection direction in a mass scanning process accordingly.

In an embodiment of the present invention, the linear ion trapping apparatus further includes a field adjustment electrode and a power supply. The field adjustment electrode is located at one end of the ion trapping apparatus along the central axis, and is symmetrical about the main symmetry plane. The power supply is used to apply a pure DC bias voltage on the field adjustment electrode, or apply a DC bias voltage based on a RF trapping voltage applied on a main RF electrode adjacent to the field adjustment electrode and apply the DC bias voltage on the field adjustment electrode, so as to adjust a dominant ejection direction or improve mass resolution during a mass scanning process.

The present invention further provides a mass spectrometry method, which uses at least one linear ion trapping apparatus described above to trap target ions, and uses the following means to adjust a mass axis shift of trapped target ions or a product of trapped target ions in a mass-selective ejection process: adjusting an amplitude ratio of RF voltages or bias DCs applied between the main RF electrodes and the auxiliary electrode.

The present invention further provides a mass spectrometry method, which uses at least one linear ion trapping apparatus described above to trap target ions, and uses the following means to adjust a mass axis shift of trapped target ions or a product of trapped target ions in a mass-selective ejection process: adjusting an amplitude of a bias DC voltage applied on the field adjustment electrode.

The present invention further provides a linear ion trapping apparatus array structure, which includes multiple linear ion trapping apparatuses described above, where at least a part of auxiliary electrodes are reused between adjacent linear ion trapping apparatuses.

In an embodiment of the present invention, the at least a part of auxiliary electrodes reused are also main RF electrodes of an adjacent linear ion trapping apparatus.

In an embodiment of the present invention, a linear ion trapping apparatus is duplicated periodically at an external side, in a direction perpendicular to the main symmetry plane, of the linear ion trapping apparatus, so as to form an ion trapping apparatus unit array.

In an embodiment of the present invention, main symmetry planes where central axes of the linear ion trapping apparatuses are located substantially intersect at a same axis.

In an embodiment of the present invention, the linear ion trapping apparatuses are circumferentially distributed around the same axis.

In an embodiment of the present invention, the central axes of the linear ion trapping apparatuses are distributed around the same axis in the form of a cone, where the central axes are gathered at one end, and divergent at the other end.

In an embodiment of the present invention, at an external side of a linear ion trapping apparatus, along the central axis, a multi-layer ion trapping apparatus unit array is formed by reusing the main RF electrodes and auxiliary electrodes.

In an embodiment of the present invention, the linear ion trapping apparatus array structure is an ion mass analyzer capable of temporally or spatially separating ions with different mass-to-charge ratios.

In an embodiment of the present invention, the linear ion trapping apparatus array structure is a linear ion trap mass analyzer.

The present invention further provides an ion analysis and detection apparatus, which includes the linear ion trapping apparatus array structure described above; and a common ion detector on the same axis and for at least one primary ion contact surface provided on the same axis.

Finally, the present invention provides a mass spectrometry method, including the following steps: using at least one linear ion trapping apparatus described above to trap target ions; applying, on the main RF electrodes, trapping RF voltages having a frequency of 5 KHz to 20 MHz and having the same phase; applying, on each auxiliary electrode, an auxiliary DC or a RF voltage used for adjusting a quadrupole electric field component and a multi-pole electric field component between the main RF electrodes; scanning an amplitude or a frequency of the trapping RF voltage applied on the main RF electrodes, so that ions in one or more ions mass-to-charge ratio ranges leave a storage space of the linear ion trapping apparatus; making at least a part of ions remaining in the linear ion trapping apparatus leave the linear ion trapping apparatus; and detecting, by using a detector, ions that leave the linear ion trapping apparatus in at least a part of time periods, so as to obtain an electric signal that changes according to ejection time and represents a mass spectrum signal of ions in at least a part of mass-to-charge ratio ranges of the trapped target ions.

In an embodiment of the present invention, ions are trapped by using an array structure formed by multiple linear ion trapping apparatuses, and a combination of electric signals that are obtained by at least one of the linear ion trapping apparatuses and represent mass spectrum signals is used to form a mass spectrum signal.

BRIEF DESCRIPTION OF THE DRAWINGS

The features and performance of the present invention are further described through the following embodiments and accompanying drawings thereof.

FIG. 17A and FIG. 17B are structural diagrams of a sector-shaped array formed by reusing an auxiliary electrode as an auxiliary electrode of an adjacent ion trapping apparatus unit;

FIG. 17C and FIG. 17D are structural diagrams of a saw-tooth array formed by reusing an auxiliary electrode as an auxiliary electrode of an adjacent ion trapping apparatus unit;

FIG. 17E is a structural diagram of a planar ion trap array in the prior art and a detection unit thereof;

DETAILED DESCRIPTION

Figure 1:
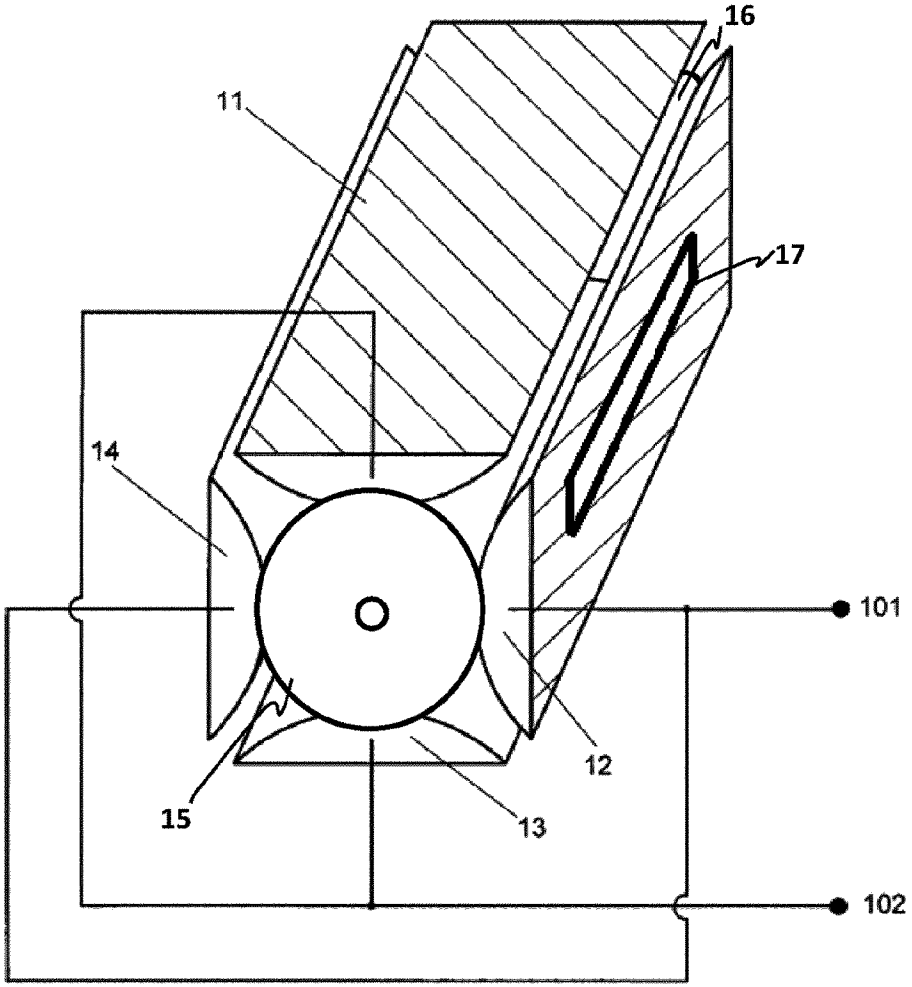
FIG. 1 is a basic principle diagram of a four-hyperboloid electrode linear ion trap.
Figure 2:
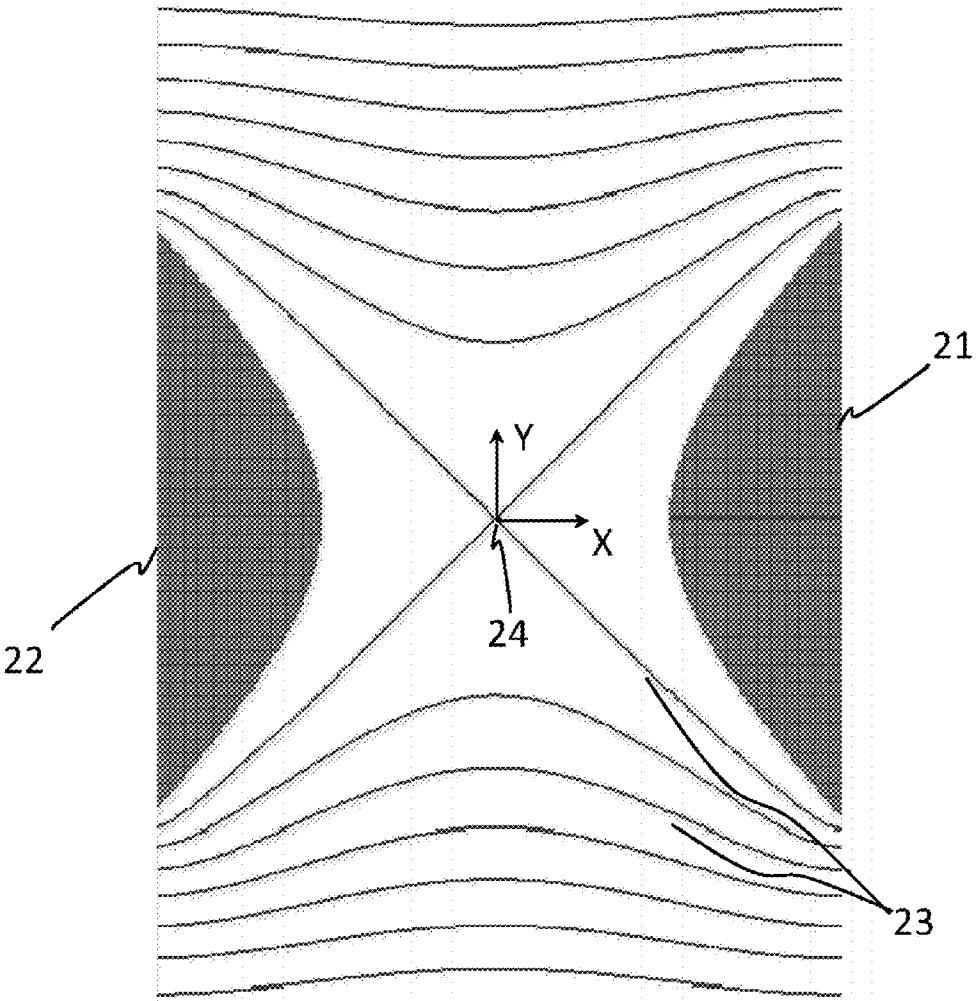
FIG. 2 is a diagram of spatial equipotential lines in a dual-hyperboloid electrode pair system.
Figure 3:
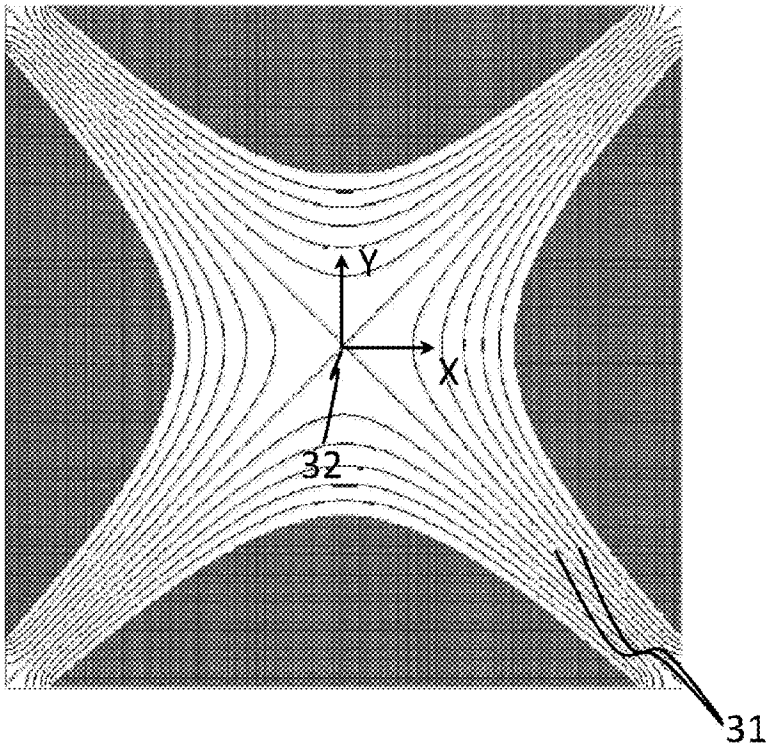
FIG. 3 is a diagram of spatial equipotential lines in a standard four-hyperboloid electrode system.
Figure 4B:
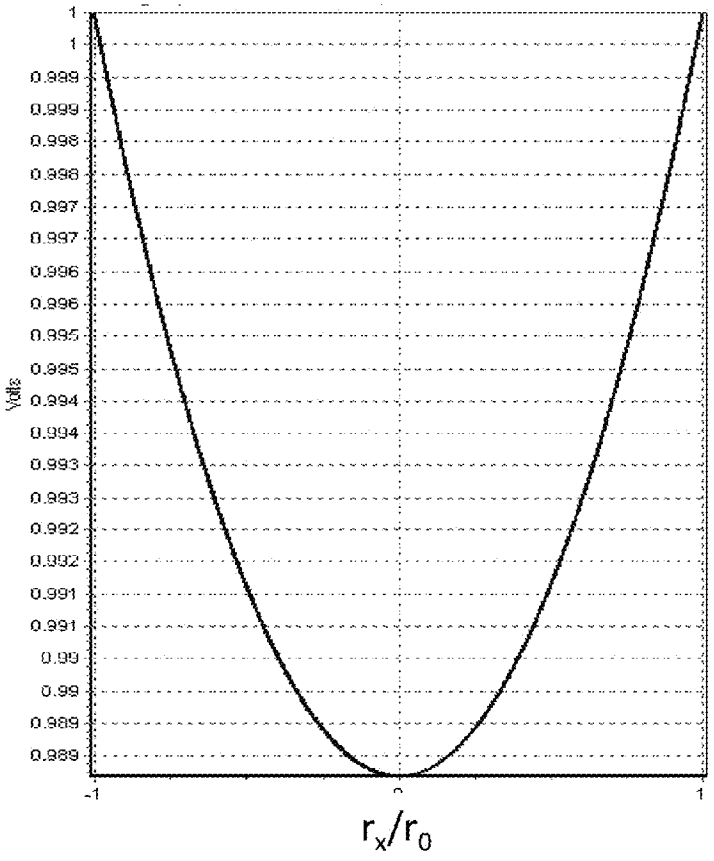
FIG. 4A and FIG. 4B are comparison diagrams of transient potential traps in a four-hyperboloid electrode system (FIG. 4A) and in a dual-hyperboloid electrode system (FIG. 4B)
Figure 4A:
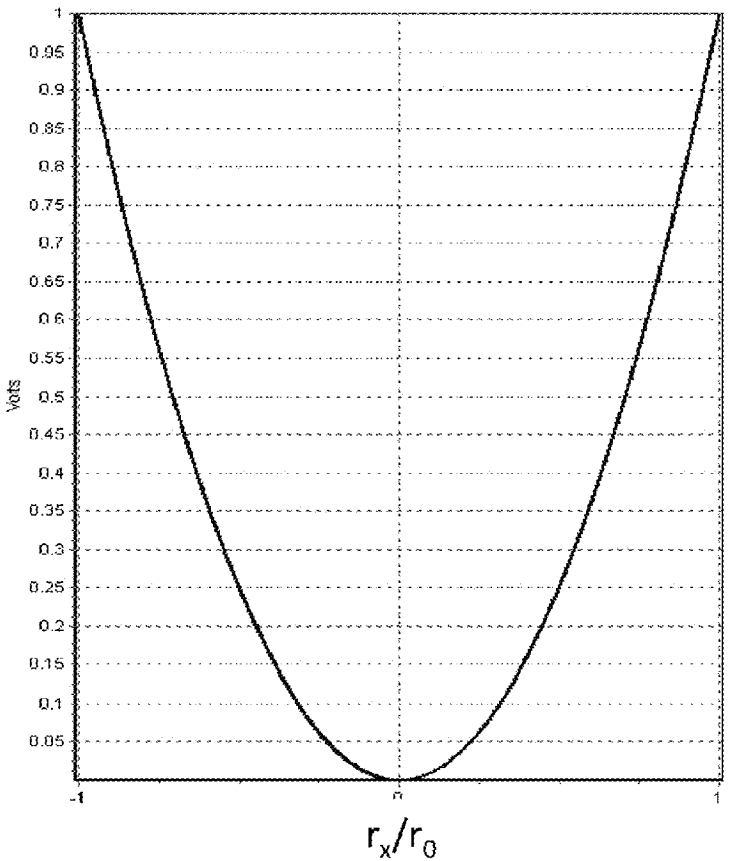

As mentioned in the background, when a two-dimensional linear ion trap apparatus is constructed by using axially extended electrodes, at least two electrodes are needed for implementation. FIG. 2 shows a cross section of a two-dimensional substantial quadrupole electric field formed by a dual-electrode structure in a direction perpendicular to the axial direction. It can be seen from FIG. 2 that, an overall structure of equipotential lines 23 of a trapping electric field formed by the structure of an electrode pair (21, 22) on the cross section is similar to equipotential lines 31 of a structure of an ideal quadrupole field shown in FIG. 3, and both have a specific space electric field intensity saddle point 24 or 32 of a substantial quadrupole electric field. In a perpendicular direction Y with no sealing electrode, the structure of the equipotential lines is significantly different from that of the ideal quadrupole field. To further reveal the difference, FIG. 4 shows a normalized potential change relationship of a dual-hyperboloid electrode structure and a four-hyperboloid electrode structure, which have the same field radius, in an ion ejection direction, namely, direction X. It can be seen from FIG. 4 that, with respect to the ideal four-electrode hyperboloid structure, a potential trap depth of the dual-electrode structure in direction X, that is, a potential difference from the deepest point of the displayed substantial hyperboloid potential trap to the edge, is merely about 2.3% of that of the ideal four-electrode hyperboloid structure. This is adverse to the ion trapping strength and ion storage limit for ions in an ion trapping apparatus with this structure.

To further reveal an electric field component difference between the two electrode systems, a complex number space multi-lobe harmonic orthogonal basis function Re $(x+yi)^n$ of electric field components in the electrode system can be expanded linearly, where Re means to take a real part operator, and i is an imaginary unit. In this type of harmonic function, in a complex plane space of a Cartesian coordinate system represented by x and y coordinates, pattern distribution is a multi-lobe graph that has alternating positive and negative polarities and is distributed around the origin, where the number of lobes of a function term corresponding to a particular parameter n is a double of n; therefore, the function is referred to as a multi-pole field. As one of exceptions, when n is 2, the basis function is degenerated to $x^2-y^2$, namely, a hyperbolic quadrupole field. When n is a greater value, for example, n=3, 4, 5, the function separately corresponds to a hexapole field component, an octupole field component, and a decapole field component. For an electric field function $\phi(x, y)$ of an actual electrode system, according to this definition, the function can be expanded as follows: $\phi(x, y)=\Sigma A_n \mathrm{Re}(x+yi)^n$, where a linear expansion factor $A_n$ in front of each multi-pole field term is each multi-pole field component of the specific electrode system, where $A_2$ is a quadrupole field component, $A_3$ is a hexapole field component, $A_4$ is an octupole field component, and so on.

A simple method for obtaining multi-pole field factors of an actual electrode system is to expand a potential coordinate relationship into a polynomial in the form of $\phi(x)$, where the coordinate on the axis X of the electrode system is in a range of a positive and negative field radius. On the axis X, the series of an actual electrode system electric field function $\phi(x, y)$ and the expression $\Sigma A_n \mathrm{Re}(x+yi)^n$ are degenerated to power series $\Sigma A_n x^n$, and by using a simple matrix polynomial expansion algorithm, each multi-pole field parameter $A_n$ can be obtained. Table 1 below shows a difference between multi-pole field factors of the two electrode systems, where the factors are calculated in the manner described herein.

TABLE 1

Comparison between quadrupole field intensity and high-order field component intensity in a four-hyperboloid electrode system and in a dual-hyperboloid electrode system

| | four-electrode structure | dual-electrode structure (no auxiliary electrode) |
|---|---|---|
| quadrupole field factor A2 | 1.00000000 | 0.02354484 |
| octopole field factor A4 | — | 0.00014922 |
| dodecapole field factor A6 | — | −0.00005111 |
| hexadecapole field factor A8 | — | −0.00000257 |
| icosapole field factor A10 | — | 0.00000011 |
| tetracopole field factor A12 | — | −0.00000023 |

It can be seen from the analysis on FIG. 4 and Table 1 that, with one pair of RF electrodes missing, the intensity of the substantial quadrupole field in the dual-electrode RF trapping system declines obviously as compared with that of the standard four-electrode structure; moreover, a strong high-order negative multi-pole field component appears in the electrode direction. According to the description about influence of multi-pole field factors on ion motion characteristics in a linear quadrupole ion trapping apparatus, as pointed in the prior art such as the U.S. Pat. No. 6,831,275, these negative high-order multi-pole field components delay the ejection of ions in the electrode direction during a normal forward scanning and mass analysis process, and affect the resolution capability. Therefore, it is necessary to use other means to improve the intensity of the quadrupole electric field in the dual-electrode pair structure, and suppress an undesirable multi-pole field parameter effect.

One of the methods for improving a quadrupole electric field in a dual-electrode pair structure is to set auxiliary electrodes around the dual-electrode pair. Different from the main dual-electrode pair, these auxiliary electrodes are away from an ion trapping area of a quadrupole electric field between the main dual-electrode pair, and the electrode surface characteristics, for example, structural errors such as location, size, and surface roughness, have a little impact on the quadrupole electric field of the ion trapping area. Therefore, machining precision of the auxiliary electrodes is far lower than that of the main dual-electrode pair, so the intensity of the quadrupole electric field in the dual-electrode pair structure is improved with few costs, and the undesirable multi-pole field parameter effect is suppressed. For example, in the Chinese Patent Application 200910054963.9 in the prior art, as regards the exception of the planar electrode, the author of the patent suggests using, in a horizontal direction of each planar RF electrode, electrode structures the same as the planar RF electrode as auxiliary electrodes, so as to improve the intensity of the substantial quadrupole electric field between the RF electrode pair and suppress the multi-pole field parameter effect. However, in this solution, the auxiliary electrodes are located on the same horizontal plane of the main RF electrodes, the quadrupole field between the auxiliary electrode pair and the main RF electrodes can only be modified to have 50% of the electric field intensity of a standard four-electrode structure. Therefore, this prior art solution has a weak ion trapping capability and an undesirable mass spectrum resolution capability during an actual application.

An embodiment of the present invention provides a simplified linear ion trapping apparatus. A symmetry plane deflection angle of auxiliary electrodes is introduced in this apparatus, so as to solve the problem of over-simplification in the prior art apparatus while saving features such as a simple structure and easy assembly during assembly of a flat-structure linear ion trap; moreover, a solution to problems such as mass axis shift of a mass spectrum caused by low-precision machining is provided. By reusing some electrode structures in the linear ion trap apparatus, a compact ion trap mass analyzer array can be formed. Each ion trap unit in the apparatus can be used as an independent mass analyzer, and ion trap units can also synchronously perform mass scanning together to obtain greater analysis throughput. In addition, when the apparatus structure is used as an array, ejection directions of multiple ion traps are approximately focused in a small area, and in a multi-channel synchronous sample mode, an extremely small collection area can be used, so that a high ion current voltage signal can be obtained even by directly using coulomb analysis; therefore, a high-quality mass spectrum signal can be obtained by using only one set of pre-amplifier-analog-to-digital conversion collection apparatus. The intensity of the ion current to be analyzed can also be enhanced by connecting multiple ion storage units in parallel in the array structure of the embodiment of the present invention, the apparatus can avoid using a high-pressure ion multiplier apparatus which cannot be used in a low vacuum degree condition. Therefore, the working air pressure thereof is only limited by a working air pressure of the ion trap; the design difficulty of an auxiliary vacuum pump system can be greatly reduced, and the design cost and weight of a mass spectrometer can be lowered, which facilitates the miniaturization and portability of the instrument.

Embodiment 1

According to the embodiment of the present invention, auxiliary electrodes are deflected by an angle relative to RF electrodes, so as to further improve the intensity of a substantial quadrupole electric field between a RF electrode pair and suppress a multi-pole field parameter effect.

Figure 5B:
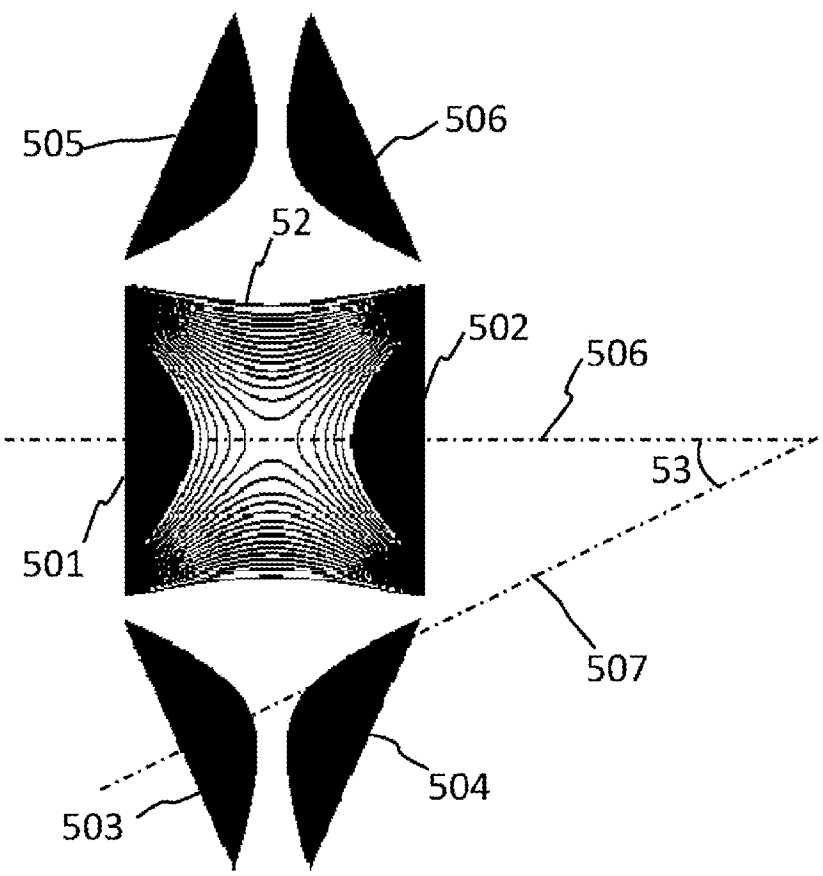
FIG. 5B shows influence of auxiliary hyperboloid electrodes disposed according to a symmetric inward deflection angle (which is 24 degrees in the drawing) of Embodiment 1 of the present invention on equipotential lines of a space electric field between main hyperboloid RF electrodes.
Figure 5A:
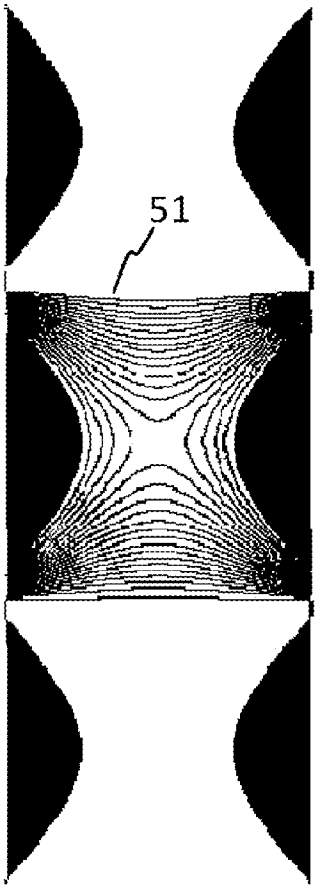
FIG. 5A shows influence of auxiliary hyperboloid electrodes disposed in parallel in the prior art on equipotential lines of a space electric field between main hyperboloid RF electrodes.

As Embodiment 1 of the present invention, referring to FIG. 5B, a proposed linear ion trapping apparatus includes an electrode system formed by a pair of hyperboloid rod main RF electrodes 501 and 502 and two auxiliary electrode pairs (503, 505) and (504, 506) located on two sides of the main RF electrodes 501 and 502. As a comparison, FIG. 5A shows a corresponding structure in the prior art. The position marked by 506 in FIG. 5B is the central axis of the ion trapping apparatus, and 506 is a main symmetry plane passing through the central axis. The pair of main RF electrodes 501 and 502 are oppositely disposed along two sides of the central axis, and extend along an axial direction. The cross section patterns, on all section planes perpendicular to the central axis, of each main RF electrode of the main RF electrodes 501 and 502 are symmetrical about a main symmetry plane that passes through the central axis. The two auxiliary electrode pairs (503, 505) and (504, 506) are each disposed as duals with the main symmetry plane 506. For example, each auxiliary electrode pair (503, 505) or (504, 506) can be disposed symmetrically about the main symmetry plane 506. Different from the structure in the prior art, in the structure of this embodiment, a working surface normal pointing direction of at least one auxiliary electrode, such as the auxiliary electrode 503, is rotated by an angle greater than 0 degree and less than 90 degrees relative to a working surface normal pointing direction of the main RF electrodes 501 and 502. To further define the rotation angle, when an auxiliary electrode also has a symmetry plane, the rotation angle can be defined by using an included angle 53 between the symmetry plane 506 of the main RF electrode pair and the symmetry plane 507 of the auxiliary electrode 503. When an auxiliary electrode has a finite number of symmetry planes, the rotation angle can be defined by a minimum value of multiple included angles between the symmetry plane, for example, 506 of the main RF electrode and the symmetry planes of the auxiliary electrode. If the auxiliary electrode has an infinite number of symmetry planes, for example, in a case where the cross section is circular, this angle cannot be defined; in this case, the system needs to include at least one another auxiliary electrode having a finite number of symmetry planes, and a minimum symmetry plane rotation angle of this auxiliary electrode is used to adjust the intensity of the quadrupole field in the system, and optimize parameters thereof to suppress a multi-pole field parameter effect.

The cross section structure of equipotential lines of electrodes and a space electric field in FIG. 5A and FIG. 5B further show improvement of the quadrupole trapping electric field between the main RF electrode pair (501, 502) brought by the auxiliary electrode rotation angle 53. For example, FIG. 5B shows influence on the quadrupole trapping electric field between the RF electrodes when the auxiliary electrodes that are on two sides of the RF electrodes and have the same structure are deflected inward by 24 degrees. It can be seen that, as compared with the case in the prior art where there is no deflection angle shown in FIG. 5A, a zero potential plane 52 corresponding to the structure provided in the embodiment of the present invention shown in FIG. 5B contracts toward the interior of the trapping space relative to a zero potential plane 51 corresponding to the structure in the prior art; therefore, the structure of this embodiment better conforms to the structure of equipotential lines of a quadrupole electric field corresponding to ideal four hyperboloid electrodes.

Figure 6:
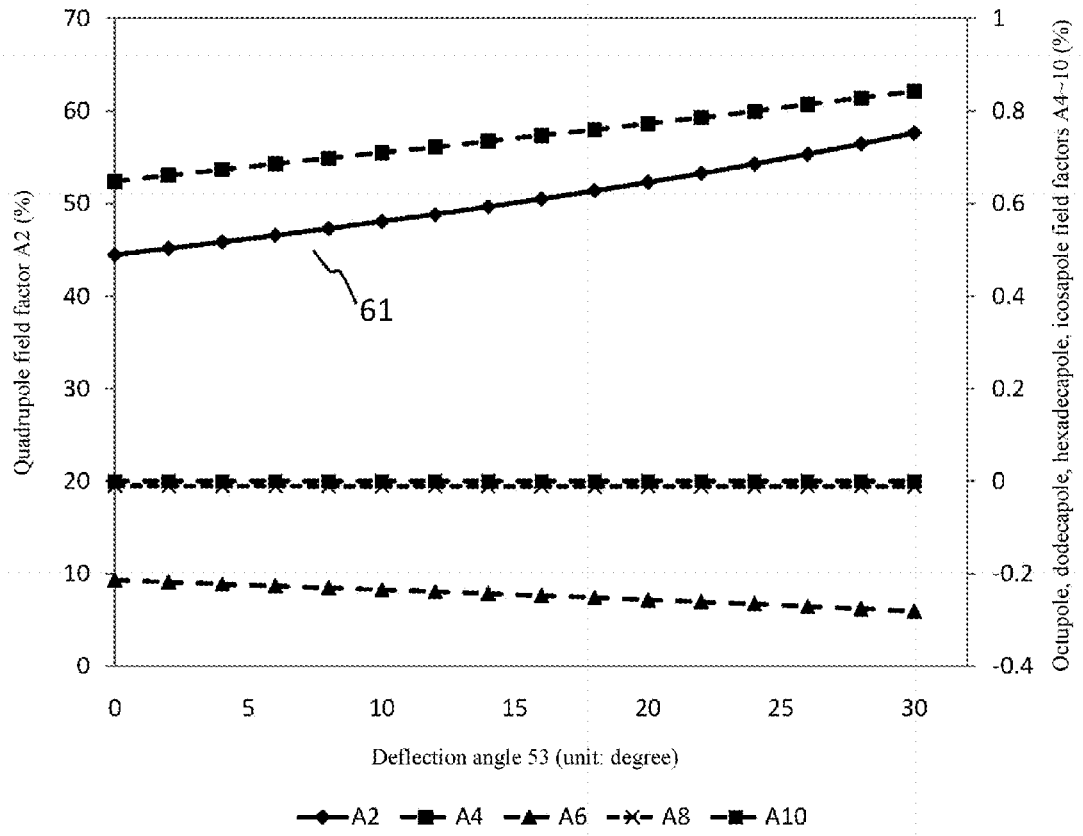
FIG. 6 shows influence of different symmetric inward deflection angles of auxiliary hyperboloid electrodes on quadrupole field component intensity and high-order field component intensity of a quadrupole trapping electric field between main hyperboloid RF electrodes.

To further describe the improvement of the quadrupole trapping electric field brought by the technical feature in the present invention, FIG. 6 shows influence of the symmetric inward deflection angle 53, which gradually increases from 0 degree (the prior art) to 28 degrees, on each multi-pole field component factor of the substantial quadrupole electric field between the RF electrodes. It can be seen from a change rule curve 61 of a quadrupole field factor shown in FIG. 6 that, in the prior art, that is, after auxiliary electrodes having the same structure as the main RF electrodes are arranged on left and right horizontal sides, the factor of the quadrupole electric field between the main RF electrodes increases from about 2.3%, which is the factor when there is no auxiliary electrode, to about 44.5%, but is still less than 50%. However, by using the present technical solution, after the four auxiliary electrodes are all rotated inward by a specific deflection angle 53, it can be found that when the deflection angle 53 increases in a range of 0 degree to 30 degrees, the quadrupole electric field factor of the apparatus further rises from about 44.5% to 57.6%, which exceeds the theoretical limit 50% of the original method.

Figure 7A:
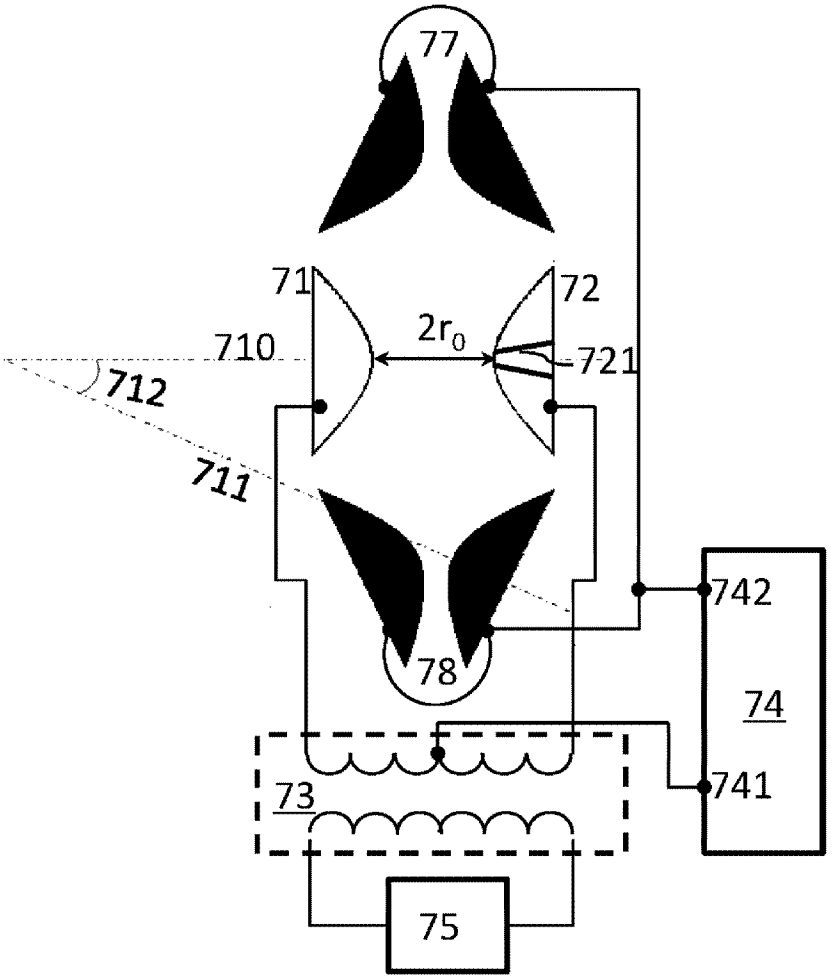
FIG. 7A is a circuit connection block diagram when an ion trapping apparatus that is according to Embodiment 1 of the present invention and includes a rotated auxiliary electrode pair is used as a mass analyzer.

The apparatus principle when the ion trapping apparatus of this embodiment is used as a mass analyzer is shown in FIG. 7A, where a pair of main RF electrodes 71 and 72 are connected to an in-phase end 741 of a main RF power source 74 through a middle end of a coupling transformer 73. Meanwhile, dipole excitation signal output by an auxiliary RF power source 75 is separately applied on the main RF electrodes 71 and 72 in a differential inverted form after passing through the coupling transformer 73, and a pair of auxiliary electrodes 77 and 78 are both connected to an inverted end 742 which outputs a voltage inverted to the output voltage of the main RF power source 74. The two auxiliary electrodes 77 and 78 are rotated by a deflection angle relative to the main RF electrode pair (71, 72), where the deflection angle is represented by an included angle 712 between a symmetry plane 710 of the main electrode pair and a symmetry plane 711 of one of the auxiliary electrodes.

The several working manners of the linear ion trap mode have been described in the prior art documents, and therefore, the working principle of the apparatus for ion mass analysis is merely described by using a mass-unstable scanning mode as an example herein. In the most common RF voltage scanning mode, sample ions produced by ionizing, in the ion trapping apparatus, gas molecules of a sample to be analyzed, or sample ions that are produced by ionizing molecules outside the apparatus and then introduced into the apparatus, can be effectively trapped in the trap through a quadrupole electric field, which is induced by a RF voltage output by the main RF power source 74, between the main RF electrode pair (71, 72). Generally, to effectively trap sample ions and possible resultants thereof, the RF voltage has a frequency range of 5 KHz to 20 MHz, and an amplitude of several volts to tens of thousands of volts. Then, the radial size of the trapped ion cloud can be effectively reduced by means of collision with buffer neutral gas such as helium, nitrogen, and argon introduced into the trapping apparatus. The motion frequency of sample ions that are trapped in the space, collide with the neutral gas, and are cooled can be changed unidirectionally by scanning the amplitude or frequency of the RF voltage. When the motion frequency of the sample ions falls in an excitation band set by the auxiliary RF power source 75, the kinetic energy and vibration frequency of target ions increase rapidly, and the target ions are finally ejected via a slit provided on a central RF electrode, and detected by a detector to form an ion current signal. Under a definite resonance condition, the mass-to-charge ratio of the ejected ions is directly proportional to the amplitude of the main RF voltage output by the main RF power source 74 or a square of the RF cycle of the main RF voltage; a sample ion current that changes in accordance with mass-to-charge ratios, that is, a mass spectrum signal that reflects abundance of sample ions with different mass-to-charge ratios, can be produced by scanning an output amplitude or a RF of the main RF power source 74.

To verify the improvement of the performance of the apparatus used as a mass analysis apparatus brought by the deflection angle 712 of the auxiliary electrodes in the solution of this embodiment, ion ejection working conditions under different values of the deflection angle 712 are compared, where a field radius of the mass analysis apparatus is 5 mm, a distance from a cutting position of the hyperboloid electrode to the field center is 10 mm, the width of the ejection slit is 0.6 mm, the main RF is 1.3 MHz, and the frequency of the excitation voltage is 433.3 KHz. When the deflection angle is 0 degree, an ejection voltage of ions of which the mass-to-charge ratio is 609 Thomson is 799 V, and when the deflection angle is 16 degrees, the ejection voltage of the ions of which the mass-to-charge ratio is 609 Thomson declines to about 738 V. When the deflection angle increases to 24 degrees, the ejection voltage of the ions of which the mass-to-charge ratio is 609 Thomson can be lower than 700 V. It can be seen that, after the deflection angle of the auxiliary electrodes is introduced, the RF working voltage needed for obtaining the same mass range declines obviously.

Figure 7B:
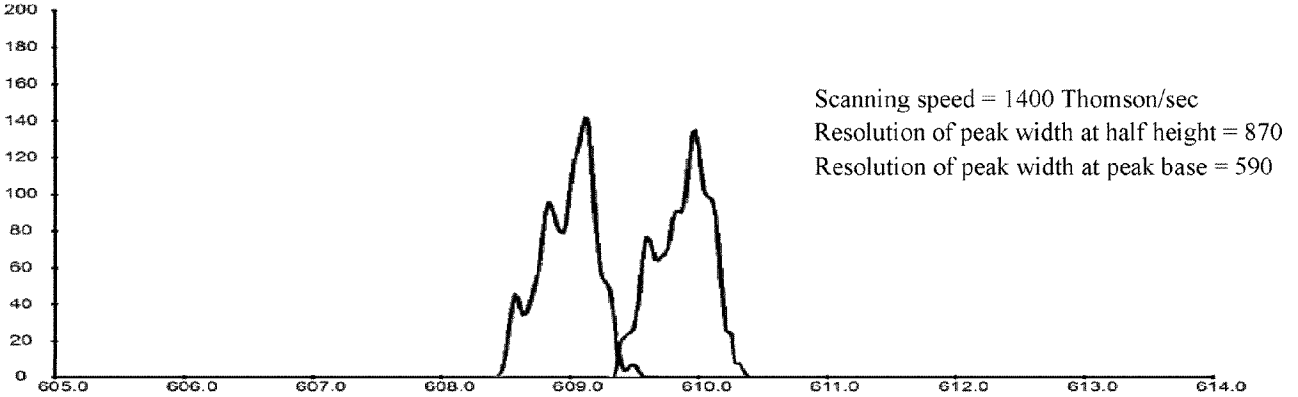
FIG. 7B and FIG. 7C are a comparison of simulated mass spectra obtained when the ion trapping apparatus shown in FIG. 7A has an angle of 0 degree (in the prior art) and an internal symmetric angle of 16 degrees, where mass spectrum resolution performance of the ion trapping apparatus used as a mass analyzer is improved by 1.5 times by introducing an internal symmetric angle feature.
Figure 7C:
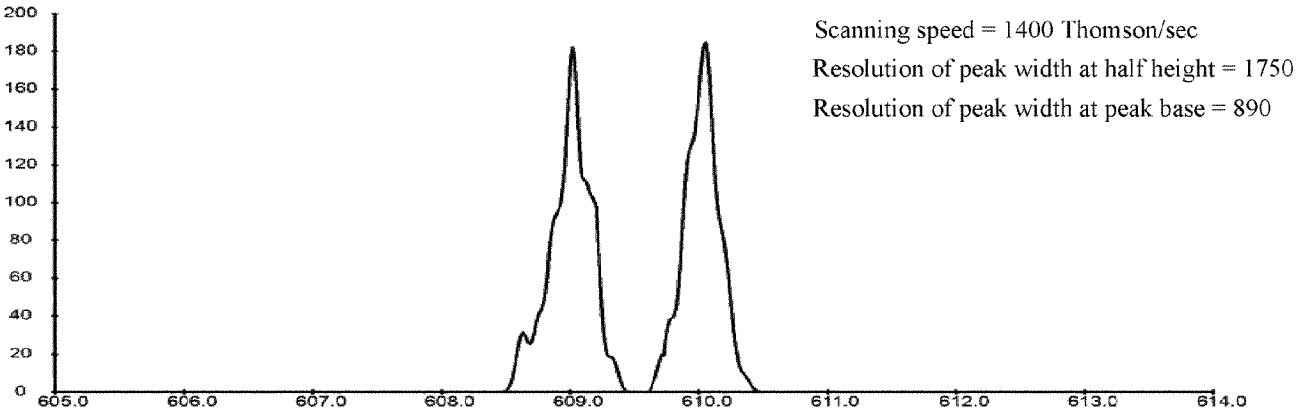

One of the important parameters for evaluating performance of a mass analyzer is mass resolution of the device, that is, a capability of distinguishing peaks of mass spectra generated by ions of adjacent mass-to-charge ratios, and the mass resolution is generally expressed by a ratio of a central point of a mass spectrum peak to a peak width at half height or peak width at peak base of the mass spectrum. FIG. 7B and FIG. 7C show a simulation result of a comparison between mass resolution performance before and after the deflection angle is applied; FIG. 7B shows mass resolution of the mass analysis apparatus for a pair of ions whose mass-to-charge ratios are 609 and 610 Thomson in the prior art, that is, when the deflection angle is 0 degree, and FIG. 7C shows mass resolution of the mass analysis apparatus for a pair of ions whose mass-to-charge ratios are 609 and 610 Thomson when the deflection angle is 16 degrees. It can be seen that, the ion cooling state is improved as the quadrupole field component is intensified, and the negative high-order field near the ejection slit is compensated for by the gradual positive increase of the lowest high-order field component, namely, the octupole field $A_4$, in the ejection direction; and with the two effects combined, the structure with a large deflection angle can obtain a desirable mass resolution. From both the perspective of the definition based on the peak width at half height and the perspective of the definition based on the peak width at peak base, the mass resolution is improved by over 50% as compared with the prior art.

Figure 8B:
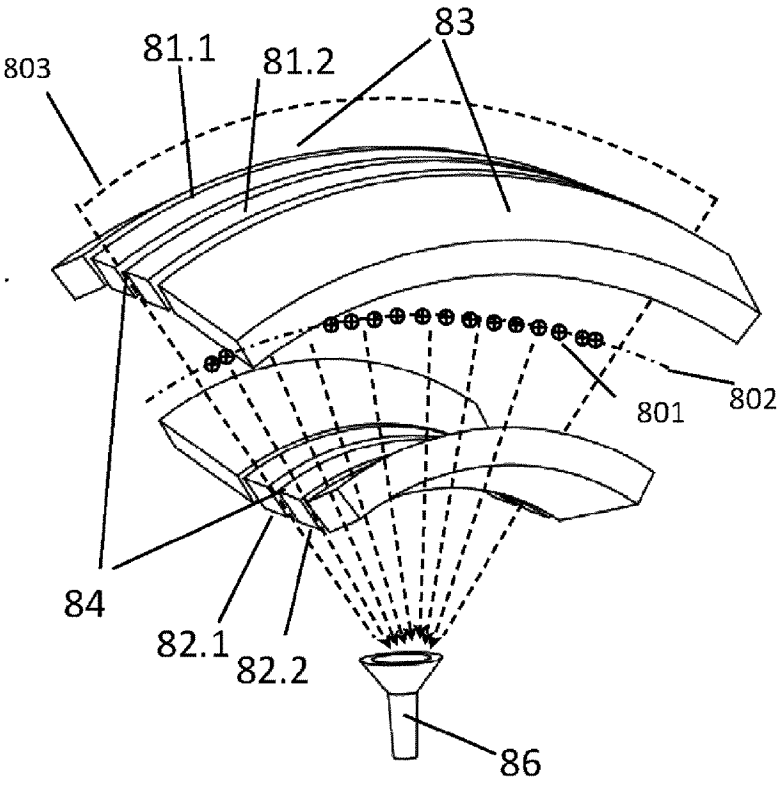
FIG. 8A and FIG. 8B show a comparison between ion ejection characteristics of an ion trapping apparatus with a straight central axis and ion ejection characteristics of the ion trapping apparatus with a bent central axis, where after the central axis is bent in a symmetry plane of a RF electrodes according to an arc, ejected ions are focused at the center of the arc.
Figure 8A:
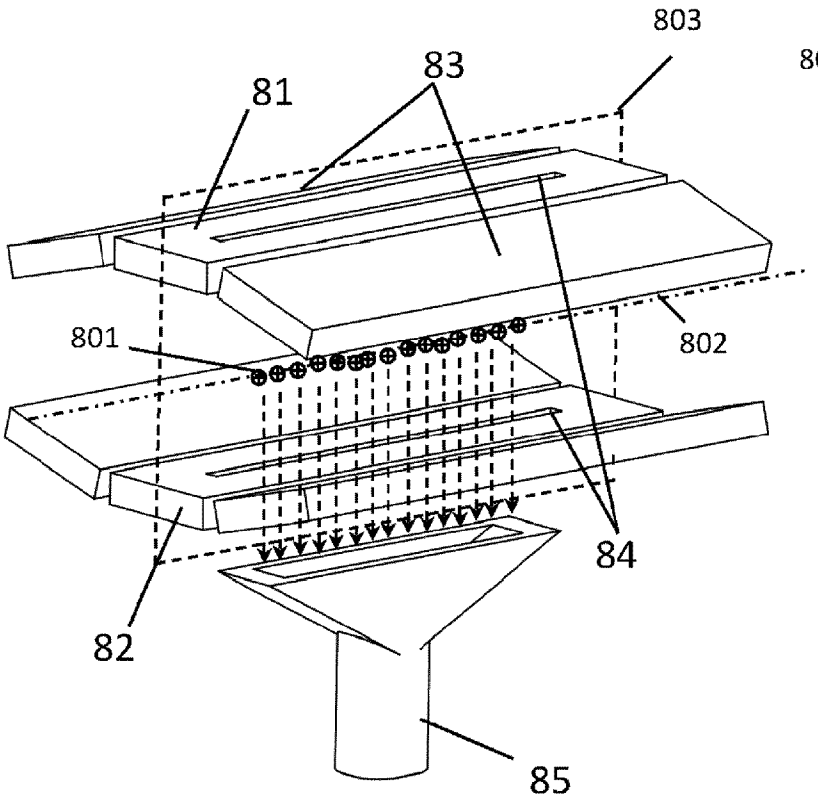

Generally, when the linear ion trapping apparatus performs mass-selective ejection in a radial direction, an ejected ion beam is usually broadened by a large degree in an axial direction, which is because when the ions are ejected in the radial direction, drive force sources thereof are distributed along a RF electric field in the radial direction of the trapping apparatus. Therefore, as shown in FIG. 8A and FIG. 8B, the pointing direction of ions when being ejected generally falls on an axis perpendicular cross section 803 thereof. Before mass spectrum scanning, ions are subject to a cooling process, and therefore, before a mass-selective excitation process, an ion cloud 801 to be analyzed is trapped in a wide range on a central axis 802 of a storage unit between the main RF electrodes; as a result, ions via a slit 84 used as an ion ejection slot are ejected almost in parallel to each other, as shown in FIG. 8A. Therefore, when the central axis 802 of the storage unit is a straight line, the detector 85 used for detecting ions ejected in the radial direction of the linear ion trapping apparatus should have a large size, so as to ensure that all ejected ions are received.

To solve this problem, FIG. 8B shows an ion ejection focus effect brought by bending a central axis of the storage unit. In this example, the central axis 802 of the storage unit is arc-shaped, and according to the force property during radial ejection of ions, ions are ejected in accordance with the normal direction of the central axis. In addition, the main RF electrode group is still symmetrical about the plane 803. According to the symmetry principle, main ions are ejected on the symmetry plane in accordance with the normal direction of the central axis. Therefore, ions ejected towards an internal side of the bend of the linear ion trapping apparatus are finally focused at the ion detector 86 at the center of the arc. Therefore, this structure may easily allow a small size of a detector, and is beneficial for the miniaturization of the whole mass spectrum device.

In addition, it should be pointed out that, a complete structure is unnecessary for each RF electrode of the main RF electrode pair in the apparatus of this embodiment. Therefore, the slit 84 (namely, ion ejection slot) required for the ion radial ejection detection may also be a gap between two components (81.1 and 81.2, or 82.1 and 82.2) of each of the main RF electrodes 81 and 82. The advantage of such design is that the axial change of the radial trapping electric field in the apparatus has less deficiency at the axial edge of the electrode, thereby making radial ejection delays of ions at different positions on the axis closer, and improving the resolution capability of the device as a mass analyzer.

In addition, although axial ends of the RF electrode pair of the apparatus in this embodiment have a fringing field effect and the apparatus can trap ions when there is no end cap, generally, structures for reflecting ions need to be disposed at the axial ends of the linear ion trapping apparatus to improve the ion trapping condition in the axial direction as much as possible. In a simplest structure, a circular-hole lens on which a blocking DC potential is applied is used, or an entire segment on which a DC potential is applied is divided at the axial end from the apparatus, so as to suppress ion escape along the axial direction. If a mass-selective ejection operation needs to be performed in the axial direction, the blocking structure may be configured as one mesh electrode on which an appropriate DC blocking potential and an axial excitation alternating current signal are applied.

Embodiment 2

According to the result shown in Embodiment 1, after the auxiliary electrodes are rotated by a deflection angle relative to the symmetry plane of the main RF electrodes, the quadrupole field factor of the device and the resolution capability of the device used as a mass analyzer are both improved. However, for a common linear ion trapping apparatus, including the design structure shown in Embodiment 1, the main RF electrode part thereof has both x symmetry and y symmetry. In other words, for these linear ion trapping apparatuses, in any cross section perpendicular to the straight or bent central axis thereof, the left and right sides are symmetric in the ion ejection direction, and moreover, the linear ion trapping apparatuses are also symmetric in the direction perpendicular to the ion ejection direction. In the symmetric structure, both the main RF voltage and excitation voltage are balanced alternating signals, which have no influence on a mean coordinate of a large quantity of ion clusters in a long time scale. Therefore, in these symmetric ion mass analyzer structures, to obtain all ion signals, detectors need to be disposed on both the front side and the rear side of the ion ejection direction, which increases the cost and size of an instrument. In addition, the response and saturation limits of the two detectors cannot be exactly the same; in the case of a large ion current, a dynamic range limit of a mass spectrometer may be determined by a detector with lower performance, and this also limits the comprehensive performance of the mass analyzer.

Similarly, according to the symmetry principle, if the mass analyzer structure is asymmetric on two sides of the direction perpendicular to the ion ejection direction, but is only symmetric on two sides of the ion ejection direction, the slit transmittance of ions during the radial ejection process can still be maintained due to the symmetry, and the asymmetry on the front side and rear side of the ejection direction can also be achieved. As a limit case, for example, for an ideal hyperboloid electrode structure, when a pair of electrodes on the ejection direction uses a concentric hyperboloid structure with different field radiuses, ions are constantly ejected from a side with a smaller field radius. Therefore, non-ejection direction may not be provided with a detector apparatus, thereby avoiding a series of problems caused by the double detectors as discussed above, and also reducing the cost and required size of the instrument.

However, generally, no asymmetric main RF electrode structure is seen in a commercial instrument. The main reason is that in an asymmetric structure, there are more parameters affecting mechanical assembly precision. In addition, considering the production cost, it is expensive to produce a set of high-precision main RF electrodes of different sizes or shapes, except for simple geometric structures such as a plane and a rod. Moreover, yield is an inevitable factor during machining of high-precision devices; if a device is used as a main RF electrode, the mass resolution performance will be severely affected where the electrode structure has an error greater than 5 microns. For a quadrupole rod mass analyzer, if an electrode structure piece has a great error, the quadrupole rod mass analyzer can still be used as a guide rod or a collision chamber, but for a main electrode structure piece of a linear ion trapping apparatus that works as an ion trap mass analyzer, because structures such as an ejection slit need to be provided on the device, the device can only be discarded if a great error appears.

Figure 9:
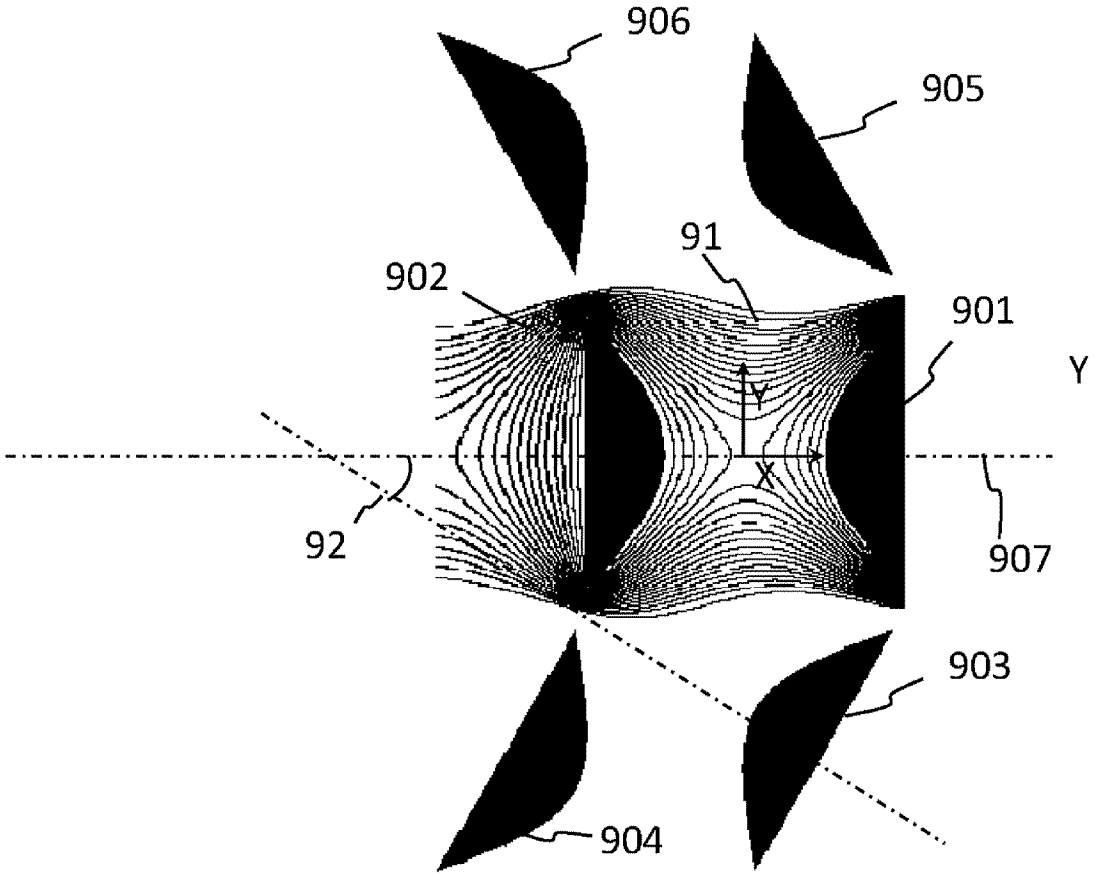
FIG. 9 shows influence of auxiliary hyperboloid electrodes that are disposed on two sides based on an asymmetric deflection angle, which is 24 degrees, on equipotential lines of a space electric field between main hyperboloid RF electrodes.

To solve the foregoing problems, in this embodiment, an electrode structure piece that has a great error and has a structure substantially similar to that of the main RF electrode is used as an auxiliary electrode, and orientational ejection of ions is implemented by using asymmetric deflection angles on two sides of a main RF electrode pair (901, 902). As shown in FIG. 9, two auxiliary electrode pairs (903, 905) and (904, 906) on two sides are each deflected by an angle 92 around a point thereof closest to the main RF electrodes 901 and 902 and toward a symmetry plane 907 of the main RF electrodes on the same side. In fact, as long as an asymmetric structure in the ion ejection direction is introduced in the auxiliary electrodes, as an overall effect, a quadrupole trapping electric field between symmetric main RF electrodes is also affected by the auxiliary electrode structure, and non-double dipole high-order electric field expansion terms $Re(x+yi)^n A_n$ such as hexapole field $A_3$ and decapole field $A_5$ appear, so that the mass-selective radial election process of the ion trapping apparatus has the characteristic of selectivity. The asymmetry property can also be seen from the distribution of electric field lines 91 on the external side.

Figure 10:
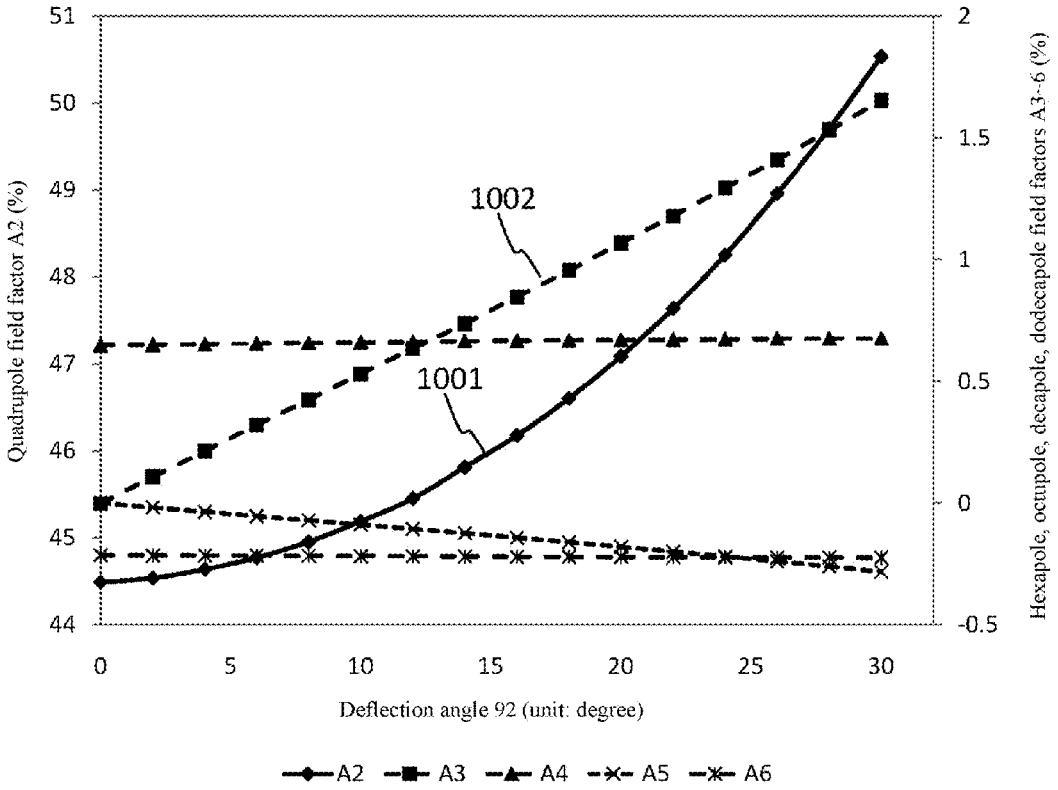
FIG. 10 shows influence of different asymmetric deflection angles of auxiliary hyperboloid electrodes on quadrupole field component intensity and high-order field component intensity of a quadrupole trapping electric field between main hyperboloid RF electrodes.

To reveal influence of such a structure modification on the ion trapping apparatus, FIG. 10 shows influence on each multi-pole field component factor of a trapping substantial quadrupole electric field between main RF electrodes when the asymmetric inward deflection angle 92 gradually increases from 0 degree (the prior art) to 30 degrees. It can be seen from a change rule curve 1001 of a quadrupole field factor shown in FIG. 10 that, even if the manner of an asymmetric deflection angle is used, when the deflection angle 92 gradually increases from 0 degree (the prior art), the intensity of the quadrupole field of the trapping apparatus also increases gradually. When the deflection angle 92 reaches 30 degrees, the intensity of the quadrupole field of the system exceeds 50%. In addition, it should be noted that, by using this manner, a relative weight $A_3/A_2$, the maximum of which is 3%, of the hexapole field can be introduced. Because of the structural asymmetry on the positive and negative sides of the ejection direction of the hexapole field, at the right side of FIG. 9, ions in the ion trapping apparatus used as a mass analyzer sense a positive high-order field component during forward scanning and be ejected at a faster speed, and in contrast, on the left side direction in FIG. 9, ions sense a negative high-order field component during forward scanning, and are not easily ejected in this direction.

Figure 11:
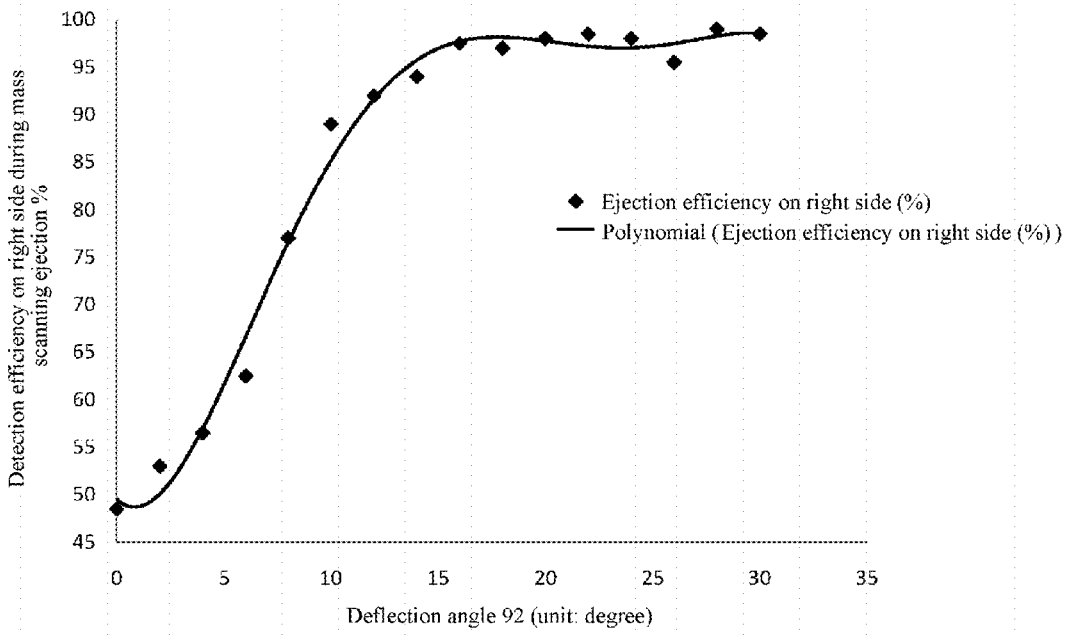
FIG. 11 shows influence of different asymmetric deflection angles of auxiliary hyperboloid electrodes on detection efficiency for ions ejected at the right side of FIG. 9.

Franzen and Douglas have explained this phenomenon in the prior art documents, and pointed out that generally, a hexapole field relative weight less than 10% can significantly improve the unidirectional ejection characteristic of the linear ion trapping apparatus. However, these results are all based on a four-electrode system. Herein, an ion optical simulation means is used to verify the unidirectional ejection characteristic of the system with two main RF electrodes according to this embodiment. It can be seen from FIG. 11 that, with the increase of the asymmetric inward deflection angle 92 and the following increase of the hexapole field relative weight $A_3/A_2$, after the deflection angle is greater than 8 degrees, that is, after the hexapole field relative weight is greater than 0.5%, the unidirectional ejection rate of the apparatus in mass analysis exceeds 75%; after the deflection angle reaches 16 degrees, the unidirectional ejection rate of the apparatus in mass analysis is almost 100%. Therefore, it can be preliminarily concluded that, to obtain desirable unidirectional ejection efficiency, a lower limit of the hexapole field relative weight should be greater than 0.5%.

It should be particularly pointed out herein that, if the electric field in the trap is adjusted by deflecting the disposition angle of auxiliary electrodes according to the method shown in FIG. 9, but the deflection angle 92 is further increased so that it is close to 90 degrees, this solution is similar to a conventional sealed four-electrode structure, where only the electrode pair (903, 905) that directly faces the sealed space has a great impact on the electric field in the trap, while the deflected auxiliary electrodes 904 and 906 outside the sealed ion trapping area only has a little impact on the electric field in the trap. Therefore, the auxiliary electrode pair (904, 906) can be omitted, so as to reduce the complexity of the system, and the objectives of adjusting the intensity and orientation of the internal electric field and changing the ion spectrum performance of the ion trap can be achieved by adjusting the symmetry plane deflection angle 92 of one remaining auxiliary electrode pair (903, 905) relative to the symmetry plane of the main RF electrodes. Similarly, if only the deflection angle 92 of the auxiliary electrode 903 is changed while the deflection angle of the auxiliary electrode 905 is not changed, similar objectives can be achieved. However, because the deflection angles of the electrodes 903 and 905 are asymmetric, the efficiency of orientational ejection of ions is affected to some extent. However, if the ion trap is merely used as a filter that retains ions of selected mass without concerning characteristics of ejected ions, this electric field adjustment method can also be used for improving a mass resolution capability of the filter.

Figure 12A:
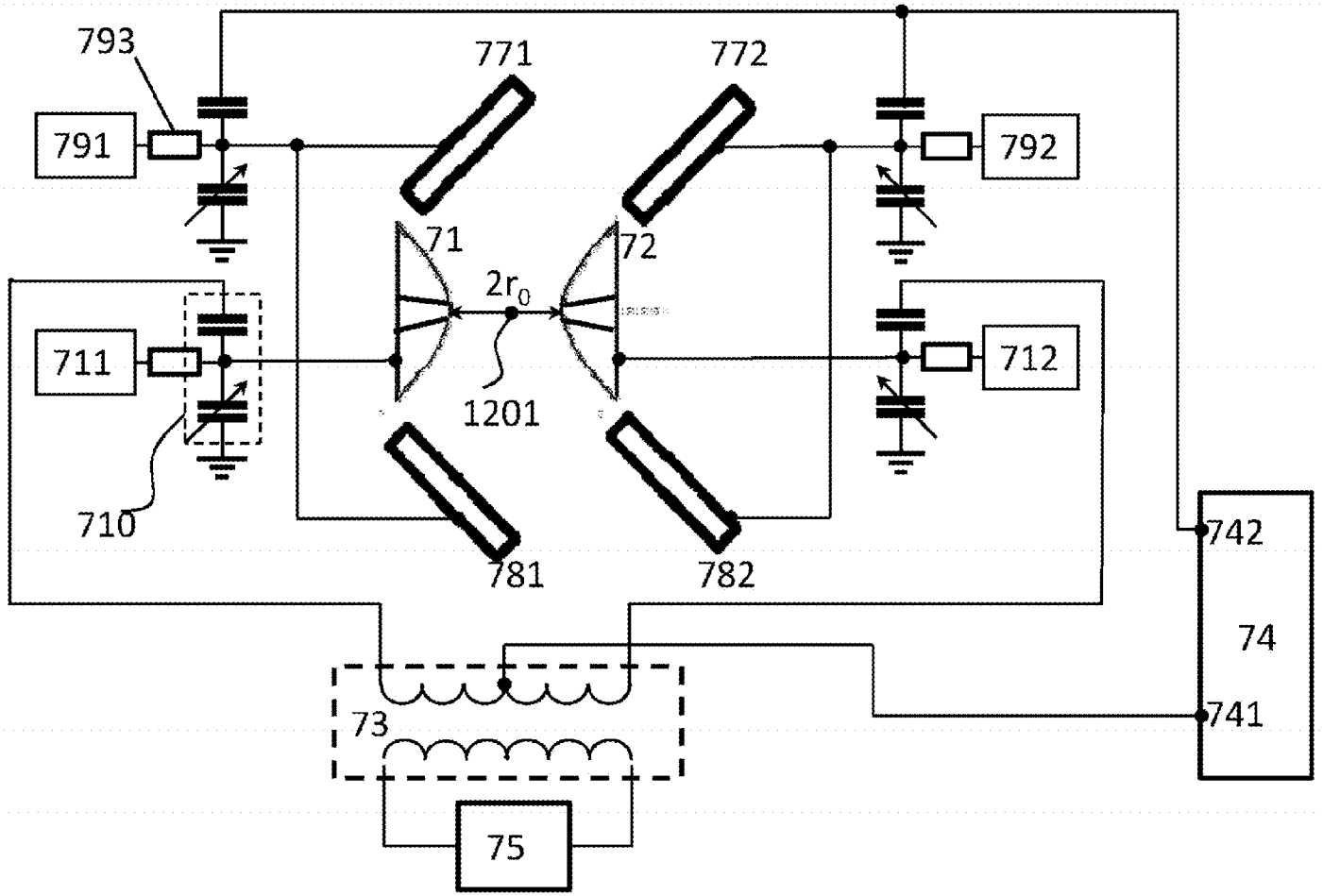
FIG. 12A is a principle diagram of an apparatus used for adjusting RF voltages and DC voltages applied on a RF electrode and an auxiliary electrode in an ion trapping apparatus that includes a rotated auxiliary electrode pair.

Another method for obtaining unidirectional ejection efficiency when a symmetric electrode structure is used is to change voltage distribution on two sides of the electrode pair, including changing amplitudes of RF voltages applied on the main RF electrodes and auxiliary electrodes and changing a DC bias difference. FIG. 12A is a circuit principle diagram for implementing this solution. A sine-wave RF voltage output by the RF power source 74 may be divided by an adjustable voltage division capacitor network such as 710, and then the voltage-divided electric signal is applied on the main RF electrode pair (71, 72); the amplitude of the RF voltage applied on the main RF electrode pair (71, 72) can be adjusted by different voltage division capacitor networks separately. Similarly, by using the voltage division capacitor network, a RF ratio between auxiliary electrode pairs, for example, between 771 and 772, or between 781 and 782 can be further adjusted. When the amplitude of the RF of one of the main RF electrode pair, for example, the main RF electrode 71, increases, the saddle point of the quadrupole trapping electric field between the main RF electrodes moves on a straight line of which the maximum range is a double of the field radius $r_0$, and moves away from the main RF electrode, causing the ion ejection ratio in this direction to decrease. Similarly, when the amplitude of the RF on a certain auxiliary electrode symmetric group such as 771 and 781 increases, because the auxiliary electrodes 771 and 781 are deflected toward the internal side of the ion trapping apparatus, the increase in the amplitude of the RF is similar to the increase of the deflection angle 92, which improves the ejection ratio of ions on the left side. The foregoing method modifies the dominant ion ejection direction without changing the symmetry of the electrode structure. However, this method sometimes requires switching of the dominant ejection direction of ions in time measurement of one mass spectrometry process, and in this case, it is inappropriate to adjust the speed by using a capacitor. FIG. 12A shows another method, that is, modifying DC biases applied on the electrodes to change a balance position of the saddle point 1201 of the quadrupole field, thereby changing the dominant ejection direction of ions. In FIG. 12A, the position of the saddle point 1201 of the quadrupole field may be changed by modifying DC bias power supplies such as 791 and 792 of the auxiliary electrodes, or DC bias power supplies 711 and 712 of the main RF electrodes. These DC bias voltages are applied on the working electrodes through a high-resistance resistor such as 793. Compared with the adjustment of the RF voltage, the adjustment of the DC voltage has a more direct impact on the saddle point of the quadrupole field and the ejection orientation efficiency. For positive ions, when a positive DC bias is applied on a RF or an auxiliary electrode on a corresponding side, the saddle point of the quadrupole field moves away from electrodes on this side, which improves the ion ejection efficiency on the opposite side. As an improvement, when the RF working voltage is of square waves, the coupling resistor 793 of the DC bias can also be replaced by a diode according to the Chinese Patent Application 200910253112.7, so as to reduce the switching resistance and switching time.

Figure 12B:
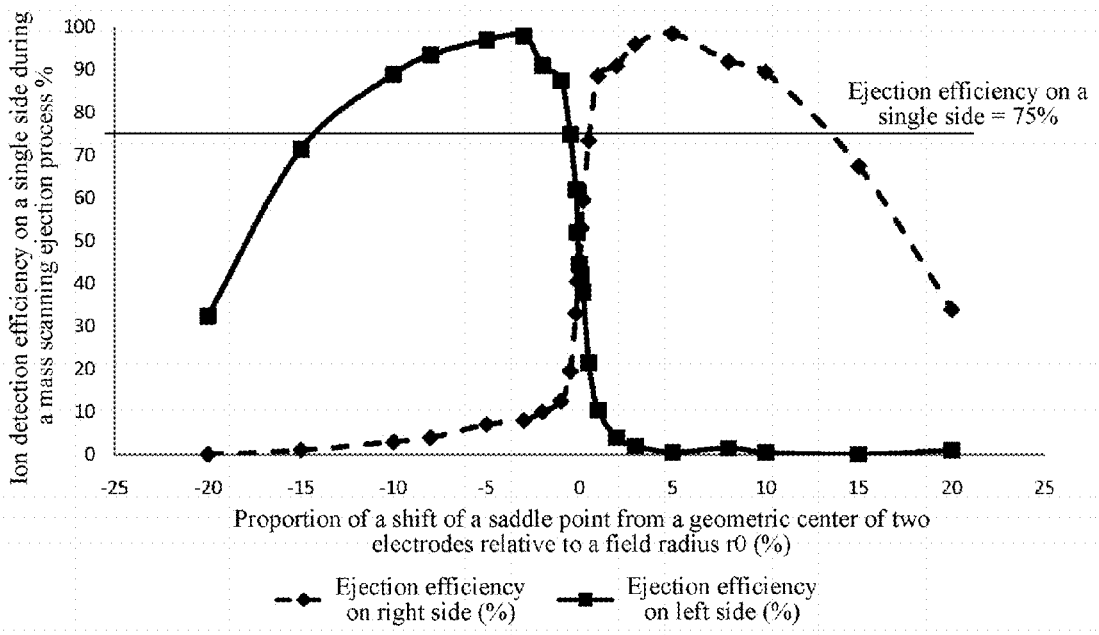
FIG. 12B shows influence of a deviation, which is caused by the voltage adjustment, between a saddle point and a geometric center of an ion trapping potential trap in the apparatus on single-side ion detection efficiency during a mass scanning and ejection process.

The method of changing the ion ejection orientation by modifying the voltage is actually an adjustment on the saddle point of the quadrupole field. FIG. 12B shows a relationship between different initial positions of the saddle point of a quadrupole field and ion ejection efficiency on the right side (that is, the positive direction of X) in FIG. 9 under a simulation condition. It can be seen from 12B that, when a substantial hyperboloid structure is used as main RF electrodes, if the voltage configuration is changed so that the deflection of the saddle point is 0.5% to 10% of the field radius r0, unidirectional ejection efficiency higher than 75% can be achieved. When the voltage configuration results in an excessive displacement distance of the saddle point, too many ions are wasted at the slit during the ejection due to the X-Y coupling of a high-order field; however, even if the deflection of the saddle point reaches 20% of the field radius 0, the unidirectional selective ejection efficiency of ions is still above 30%, and in this case, ejection of ions in the opposite direction can be ignored. Therefore, with the ion unidirectional ejection effect implemented by adjusting the deflection of the saddle point between 0.5% to 20% of the field radius 0 according to the above method, detectors can be arranged at the slit on only one side of the ion trap to detect ions, thereby avoiding an ion current statistical error caused by possible fluctuations of the ion ejection efficiency on two sides, and also simplifying the structure of an ion detection apparatus.

Figure 13A:
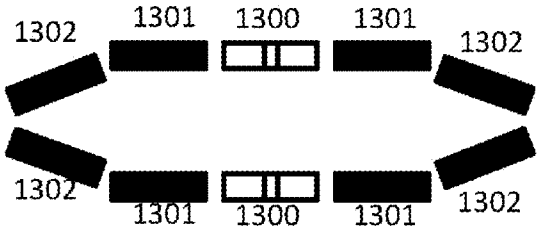
FIG. 13A and FIG. 13B show a linear ion trapping apparatus that is constructed by physical planar electrodes and has two pairs of auxiliary electrodes and a process for constructing the linear ion trapping apparatus by using surface thin layer electrodes.
Figure 13B:
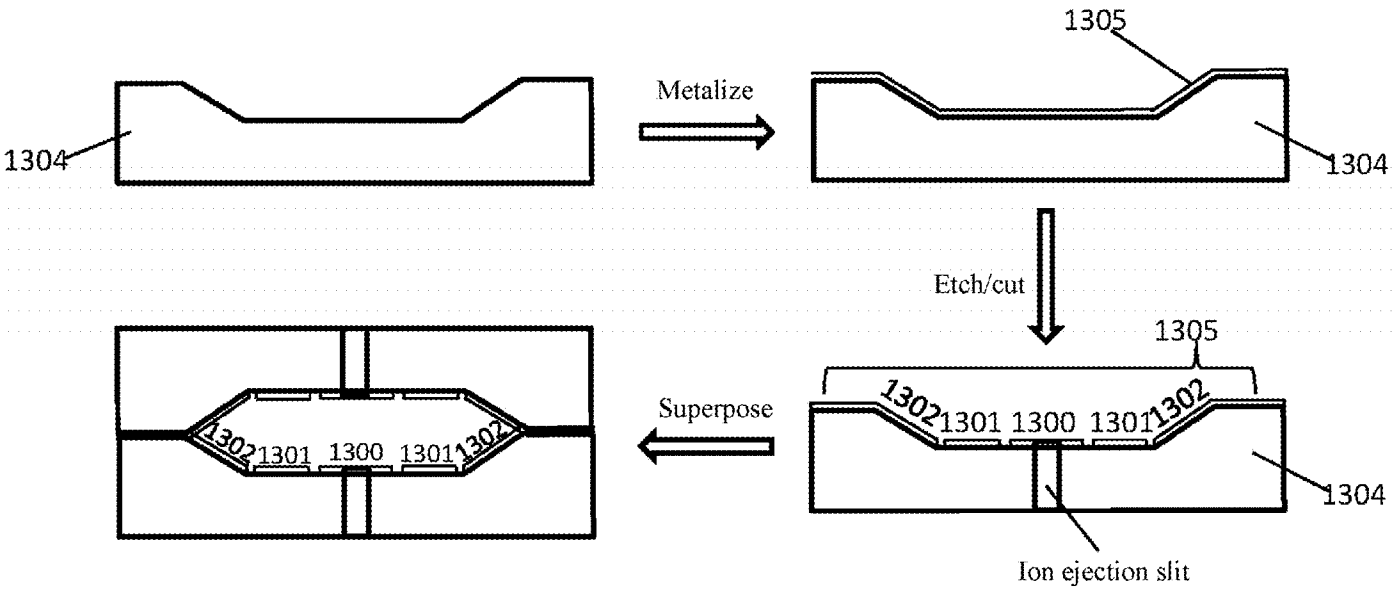
Figure 14:
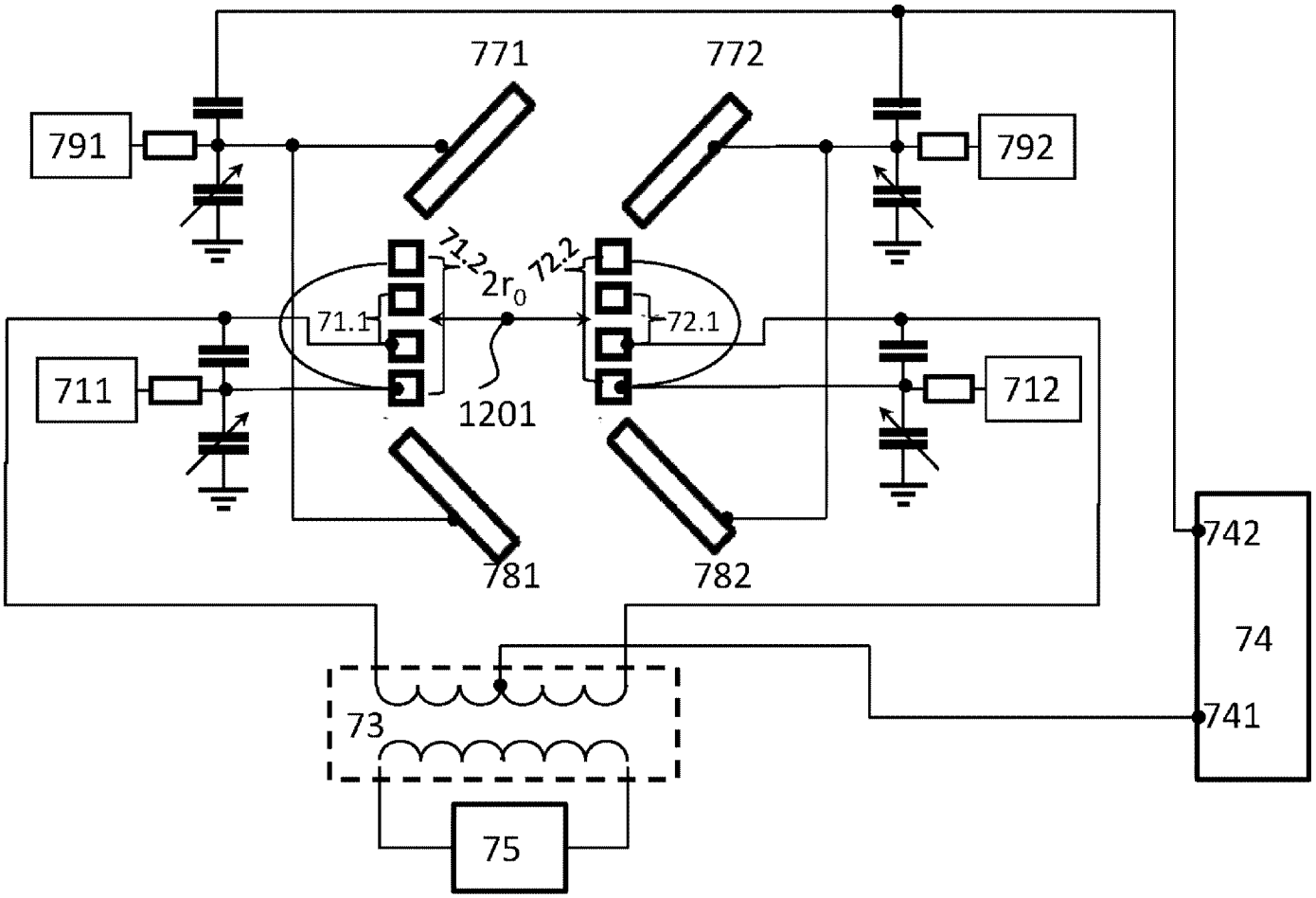
FIG. 14 is a circuit principle diagram for driving and adjusting a linear ion trapping apparatus having a second auxiliary electrode, where a first auxiliary electrode pair is driven in a voltage division manner by a RF voltage having a same phase as that for driving a middle electrode, and the second auxiliary electrode pair is driven by an inverted voltage.

The foregoing embodiment is a solution mainly for a high-precision main RF electrode structure such as a hyperboloid electrode. If a planar electrode technology is used to process the main RF electrode structure or auxiliary electrode structure, because it is easy to achieve micron-scale precision during machining of a planar electrode, the additional requirements for field asymmetry thereof and the like are not necessarily implemented by using a completely symmetric main RF electrode structure, which brings about higher flexibility. The disadvantage of the planar electrode structure mainly lies in that the negative high-order component near the ejection slit is severer than that of the hyperboloid and round-surface structure. To solve this problem, the ion trap usually needs to be stretched in the ejection direction relative to the field radius position where the hyperboloid or round-surface electrode is located, where the ratio is usually between 1.15 and 1.35. In addition, because a planar electrode, especially an auxiliary electrode, is easy to machine, to further improve the mass resolution capability of this type of structure, as shown in FIG. 13A, it may be considered to add another one or two pairs of secondary auxiliary electrodes such as 1302 on two sides of the original auxiliary electrode 1301 of the main RF electrode 1300. Moreover, because the space electric field near the electrode is actually affected by the surface feature of the electrode only, as shown in FIG. 13B, a high-precision base of a rigid insulation material such as ceramic may be manufactured (not shown), then a thin-layer metal working electrode 1304 is grown on the base, and multiple pairs of auxiliary electrodes are manufactured by using a pattern 1305 on the thin-layer metal. As shown in FIG. 14, these auxiliary electrodes may also be used as adjustment electrodes such as 71.2 and 72.2 of the main RF electrodes, and a part of voltages applied on the main RF central electrodes such as 71.2 and 72.2 is applied on the adjustment electrodes, so that the adjustment electrodes and the main RF central electrodes have the same phase. Therefore, potential near the ion ejection slit is high, so as to cancel the negative high-order field component near the original ejection slit of the planar electrode, thereby improving the resolution capability of the device as a mass analyzer.

Embodiment 3

Figure 15:
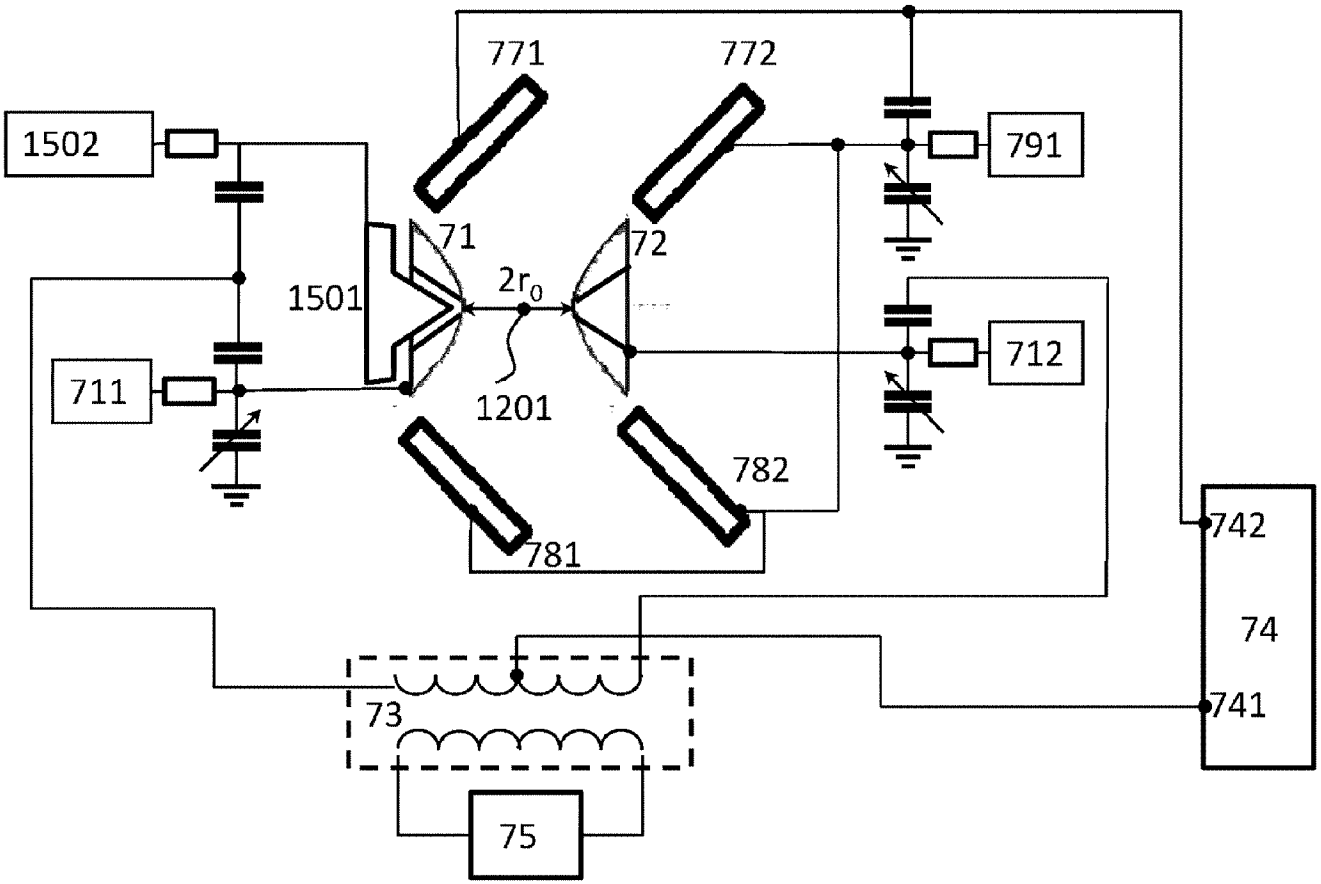
FIG. 15 is a circuit principle diagram for driving a linear ion trapping apparatus having a field adjustment electrode.

The dominant ejection direction of an ion trap mass analyzer can be adjusted conveniently by directly modifying the DC voltage on each electrode in the trap. However, in such modification, a high DC component is mixed in the electric field of the analyzer, causing mass discrimination on ions with a higher mass-to-charge ratio and a lower higher mass-to-charge ratio. To solve this problem, a field adjustment electrode structure may be introduced. As shown in FIG. 15, a field adjustment electrode 1501 of this embodiment is located on an external side of a main RF electrode 71 on one side of the axis of an ion trapping apparatus, and is symmetrical about a symmetry plane of main RF electrodes. The symmetry ensures that an electric field applied on the field adjustment electrode does not produce obvious disturbance, which is perpendicular to the ejection direction, on ions that move on the symmetry plane of the linear ion trapping apparatus, In addition, this embodiment further includes a power supply 1502, used for applying a pure DC bias voltage on the field adjustment electrode 1501, or when coupling resistance is high, applying, on the field adjustment electrode 1501, a RF trapping voltage on the basis of a DC bias voltage applied on the adjacent RF electrode. Main parts of the field adjustment electrode 1501 are shielded after the main RF electrode 71; therefore, adjustment on the DC bias of the field adjustment electrode 1501 only has a strong suppression effect on ions ejected via the slit on the RF electrode 71, but barely affect the adjustment of ion storage at the axis center of the linear ion trapping apparatus. Apart from adjusting the dominant ejection direction during mass scanning by selectively blocking ion ejection in the direction where it is located, the suppressing DC voltage of the field adjustment electrode 1501 can further mitigate resonance frequency and phase detuning when ions are about to be ejected from the ion trap, so as to avoid the ion ejection delay and improve the mass spectrum resolution capability of the ion trapping apparatus as a mass analyzer.

The field adjustment electrode further has a special function, which is, adjusting a mass axis shift relationship of trapped target ions or a product thereof during a mass-selective ejection process of the ion trap by changing the voltage of the field adjustment electrode. Generally, the influence of the voltage of the field adjustment electrode on the mass resolution capability of the ion trap mass analyzer is a jump platform, that is, when the voltage of the field adjustment electrode exceeds a limit value, the resolution capability of the mass analyzer is generally maintained at a high level within a range of 1.5 times of the limit value, and the change of the mass resolution is generally less than 15%. In this range, by adjusting the field adjustment voltage, the mass range adjustment within millesimal of the maximum range may be achieved, and the adjustment precision generally reaches 5 ppm per volt. The field radius of a common commercial quadrupole mass analyzer is about 5 mm, and the change of the field radius caused by various machining errors generally does not exceed 5 microns. Therefore, this method can effectively correct the mass axis of the ion trap mass analyzer in terms of hardware.

Apart from the fine adjustment method of adjusting the bias voltage of the field adjustment electrode, the mass axis of the ion trapping apparatus can also be adjusted roughly by directly modifying a ratio between RF voltages applied on the main RF electrode and the auxiliary electrode. This means may be implemented by a variable-capacitor voltage division bridge between each electrode and a RF power source end in FIG. 15. In addition, this means may also be implemented by changing the DC bias on each RF electrode and auxiliary electrode, so as to change a mass axis conversion relationship in a mass analyzer mode by means of the influence of the quadrupole DC electric field in the trapping apparatus. Because these changes directly act on the working electrodes, a scaling ratio of the mass axis of the DC or RF offset per volt is generally about 1000 ppm.

Another important function of these methods is to correct the mass axis shift, which is caused by mechanical machining errors, between linear ion trapping apparatuses having the same design structure, so that the linear ion trapping apparatuses fit each other. Generally, for a single mass analyzer system, the mass axis shift can also be eliminated through correction by using simple software. However, for a mass analyzer array formed by single-channel mass analyzers, such a shift affects ions separately stored by multiple ion traps, and then affects the quality of combined mass spectrum information obtained in an analysis process on ions that are selectively ejected according to the same mass axis.

Figure 16C:
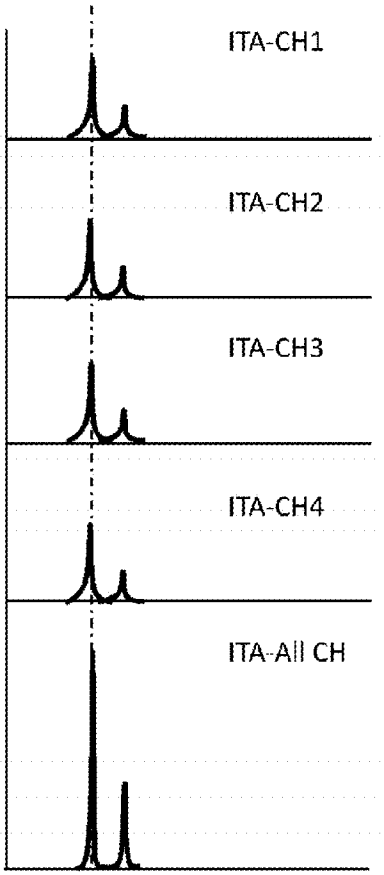
FIG. 16C shows degradation of a total mass spectrum signal when an analysis unit with an undesirable mass resolution capability exists in an array.
Figure 16B:
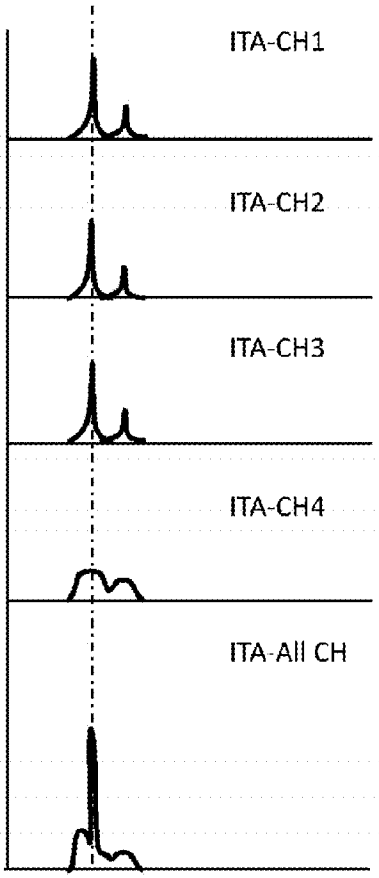
FIG. 16B shows improvement of a peak and resolution of a total mass spectrum signal after a relative shift of a mass axis between analysis units is eliminated through adjustment by using a field adjustment electrode and a RF working voltage.
Figure 16A:
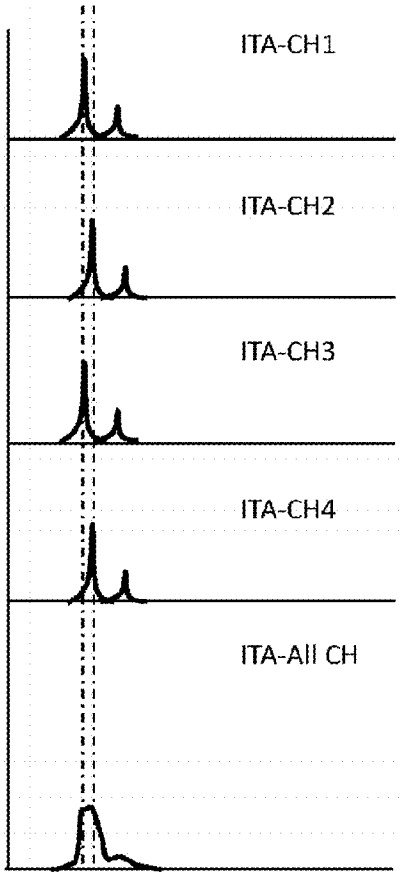
FIG. 16A shows influence of a relative shift of a mass axis of each ion analysis unit in an array on resolution of a total mass spectrum signal.

For example, it is conceived in the U.S. Pat. No. 7,157,699 that, through synchronous sampling of multiple channels in a simple reuse array of rectangular ion traps, currents of ions having selected mass and ejected from N low-cost rectangular ion traps in simple permutation are overlaid and collected by using a same microchannel plate ion detector, so as to form a mass spectrum detection channel with high analysis throughput. In an ideal case, a mass spectrum signal of N times peak can be obtained on the combined channel; however, considering a ratio between the machining errors (0.01 mm) of the low-cost rectangular ion trap and the field radius (about 5 mm), for ions of about 500 Thomson, a maximum possible deviation of mass axes of different analysis units in the combined channel may be +/−1 unit mass number. Therefore, as shown in FIG. 16A, due to the mass axis shift caused by the typical mechanical machining error of each ion trap, the height of the ultimate combined signal fails to reach N times that of a single channel, and moreover, the overlaid mass spectrum peak obtained ultimately is broadened and loses unit mass resolution, causing the accuracy of the qualitative analysis to decline severely. In addition, the synchronous scanning working mode of the simple array of low-cost mass analyzers also has a "cask effect", that is, as shown in FIG. 16B, when the synchronous scanning spectra of the units are added, the maximum mass resolution of the total spectrogram is limited by the analysis unit with the lowest mass resolution capability.

By adjusting the DC bias applied on the field adjustment electrode of each unit, or adjusting the ratio between RF voltages on the main RF electrode and the auxiliary electrode, the defect in the above synchronous analysis method can be solved. First, different mass analyzer units are adjusted separately, so that mass axes of the analysis units are synchronized in a time axis in terms of hardware. Moreover, the degradation by extremely undesirable mass spectrum resolution, which is caused by a machining difference of a specific analysis unit, on the total mass spectrogram can also be avoided by means of independent mass resolution optimization performed by the field adjustment electrode of each unit on each member analysis unit. Finally, the broadening of the mass spectrum peak caused by the two adverse differences on the traps is suppressed; as shown in FIG. 16C, a high-quality overlaid spectrogram is obtained, and the overall mass resolution performance of the mass analyzer array is improved.

Embodiment 4

With the development of the analysis technology, high throughput, low detection limit, and easily met working conditions have become common requirements on various analysis methods. Characteristics of an ion trap mass analyzer array meet the three requirements: when each channel of the mass analyzer array works separately, the screening process of a suspected material under test can be accelerated exponentially; the mass analyzer array can also work in a parallel manner and output an accumulated spectrogram at a same detector, and an extremely low detection limit can be obtained with a preconcentration characteristic of the ion trap mass analysis. In addition, a strong ion current can be collected when multiple ion traps work in a parallel manner, so it is no longer necessary to use an ion multiplier susceptible to the vacuum degree, thereby reducing cumbersome and expensive high-vacuum acquisition devices such as a molecular pump, and lowering the working condition requirements of the mass spectrometry instrument.

As cylindrical machining is generally more difficult than revolution machining, during machining of a linear ion trapping apparatus array, high-precision cylindrical electrodes with different shapes should be avoided as much as possible. The foregoing embodiment 2 and embodiment 3 have explained how to implement an ion trap unit with desirable mass resolution performance by using planar electrodes which are easy to machine, and improve the uniformity of the units by using a peripheral circuit. However, it is inadvisable to improve the uniformity of the units in the array by merely machining the ion trapping apparatus of the present invention repetitively for each unit and improving the mechanical machining level, because although the high-precision structure of the auxiliary electrode has little influence on the mass spectrum performance of the unit, the size error of the auxiliary electrode affects parameters such as an effective field radius and an initial excitation voltage of each unit. Therefore, in an array system, how to reduce the number of auxiliary electrodes with great errors and the influence thereof is an important issue in controlling the mass spectrum performance of the array system, especially in a mode in which the units perform sampling synchronously in a parallel manner.

This embodiment shows a method for constructing a compact ion trap mass analyzer array by reusing a part of electrodes of an adjacent linear ion storage unit, as shown in FIG. 17A to FIG. 17D. First, in an area between the adjacent linear ion trapping apparatuses, such as a structure 171 (as shown in FIG. 17A or FIG. 17C), at least a part of auxiliary electrodes, such as 172.1, 172.2, 173.1, 173.2, 174.1, and 174.2, are used as auxiliary electrodes of adjacent ion trapping apparatus units, so as to form an array of multiple linear ion trapping apparatus units that are separated by auxiliary electrode areas, as shown in FIG. 17B and FIG. 17D, thereby reducing the manufacturing complexity of array analysis devices of the linear ion trapping apparatus.

In such an ion trap mass analysis array, because unit traps (areas between hollow electrodes) are separated by a long auxiliary electrode, RF amplitude scanning or frequency scanning of the unit traps can be performed separately when the auxiliary electrodes are grounded. A method for applying a dipole excitation voltage required to be applied for improving the resolution capability of the unit trap is the same as the basic method shown in FIG. 7, that is, the voltage is applied by using an isolation transformer having a secondary center tap, so that RF voltages applied between opposite central RF electrodes such as 171.3 and 171.4 are the same, while dipole excitation voltages are inverted to each other.

When the units require synchronous scanning, the ion trap array may have two manners for applying RF voltages. In the first manner, the auxiliary electrode between every two unit traps is grounded, and RF electrodes of adjacent unit traps may have in-phase voltages, or signals that are inverted to each other and have exactly the same amplitude. In the second manner, voltages on RF electrode of adjacent traps have the same phase, while RF signals that are inverted to each other and have the same amplitude are applied on auxiliary electrodes between the unit traps; the advantage of this manner is that, the depth of the potential trap in each unit trap is doubled, so that trapped ions are better cooled, thereby obtaining a high mass resolution capability.

FIG. 17B further shows two basic modes of an array mass spectrum analyzer formed by the ion trap array. When the array mass spectrum analyzer works as a multi-channel detector, the method in Embodiment 3 may be used, in which DC biases applied on the auxiliary electrodes are adjusted so that ions are orientationally ejected to peripheral discrete detectors. When the array mass spectrum analyzer works as a single-channel detection apparatus, a similar method may be used so that ions are ejected and focused at the same detector at the center. Because the symmetry planes of the discrete ion trap units approximately intersect at one point, the requirement on a collection area of the detector may be the same as that of a common detector, which makes selection easy. Other ion trap arrays do not have this advantage. In addition, when a single detector is used, noise caused by transient response fluctuation of different detectors can be avoided.

Such a manner of reusing auxiliary electrodes between ion trap units 171 may also be performed according to FIG. 17D. Different from the sector array shown in FIG. 17B, reuse of auxiliary electrodes in FIG. 18B uses a zigzag structure, so that the array has an infinite extension space in the horizontal direction in the drawing. Auxiliary electrodes having a certain deflection angle relative to the main RF electrodes are designed between ion trap units formed by the main RF electrode pair, and therefore, ions in each ion trap unit can be ejected unidirectionally, which increases an interval between detectors of adjacent channels while a horizontal interval between ion traps is not changed. Compared with the prior art solution shown in FIG. 17E, in the ion trap array mass analysis apparatus designed in the solution of this embodiment, a larger installation space is reserved between analysis channels for a detector which is difficult to miniaturize, so that mechanical design can be implemented more easily, and the interference between high-voltage electric fields of adjacent detector units.

Figure 18A:
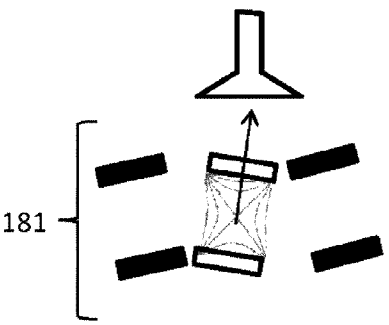
FIG. 18A and FIG. 18B are structural diagrams of a saw-tooth array formed by reusing an auxiliary electrode as a RF electrode of an adjacent ion trapping apparatus unit.
Figure 18B:
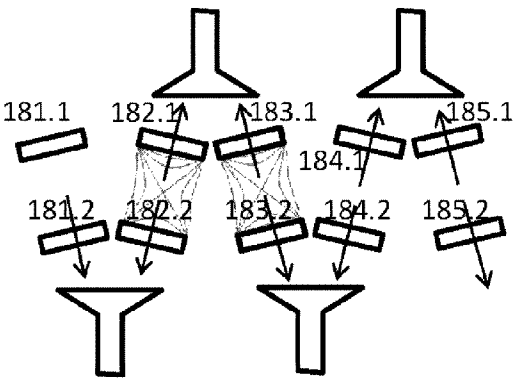

When more attention is paid to the synchronous parallel mode of the ion trap mass analyzer array, as shown in FIG. 18A and FIG. 18B, as a further preferred solution of the present invention, between the adjacent linear ion trapping apparatuses, at least a part of auxiliary electrodes, such as 182.1, 182.2, 183.1, 183, 2, 184.1, and 184.2, are reused as RF electrodes of adjacent ion trapping apparatus units, so as to form an array of multiple directly adjacent linear ion trapping apparatus units, thereby further reducing the manufacturing complexity of array analysis devices of the linear ion trapping apparatus.

Figure 18C:
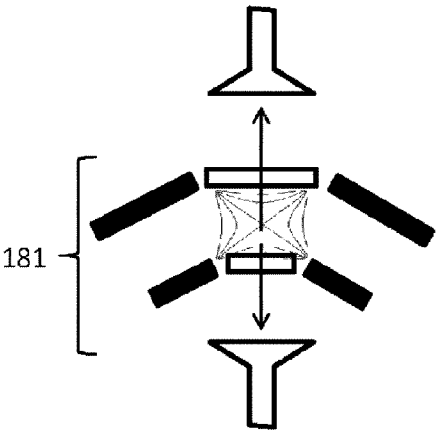
FIG. 18C and FIG. 18D are structural diagrams of a sector-shaped array formed by reusing an auxiliary electrode as a RF electrode of an adjacent ion trapping apparatus unit.

In the embodiment shown in FIG. 18B, two auxiliary electrode pairs are merely disposed as duals but not symmetrically on two sides of the main symmetry plane. A disadvantage of this embodiment is that, for each ion trap unit such as 181, symmetry on two sides of the ejection direction is destroyed, which affects ion ejection performance of the ion trap, and also causes problems, such as motion coupling and difficulty in ion cooling, related to the mass resolution capability. These problems are solved in FIG. 18C and FIG. 18D. With the structure design similar to that of FIG. 17B, the apparatus can flexibly switch between a multi-channel detection solution and a combined synchronous detection solution.

When the units require synchronous scanning, the mode for applying RF voltages of the ion trap array is as follows: voltages on RF electrodes of adjacent unit traps are inverted to each other but have the same amplitude, which is the same as the second voltage applying manner of the apparatus shown in FIG. 17B. The depth of the potential trap in each unit trap is enhanced by adjacent areas that are inverted to each other, and it is ensured that structures of trapping electric fields between adjacent units are exactly the same. There is no auxiliary electrode with low machining precision, and therefore, the uniformity of the units during synchronous scanning can be ensured.

A problem of this solution is that the RF working condition of each analysis unit cannot be adjusted separately. Therefore, when each unit works in a different mass spectrum scanning condition, the common RF voltage amplitude scanning or frequency scanning manner cannot be used. To solve this problem, the frequency of a dipole excitation voltage applied on each unit through an isolation transformer may be scanned, and by changing the excitation frequency, ions having different mass-to-charge ratios and having respective secular resonance frequencies are sequentially resonated and ejected, so as to obtain a mass spectrum. This solution can also be combined with amplitude scanning or frequency scanning of a common RF of all channels, so as to improve the mass spectrum resolution performance in a scanning dipole excitation frequency mode.

Figure 18D:
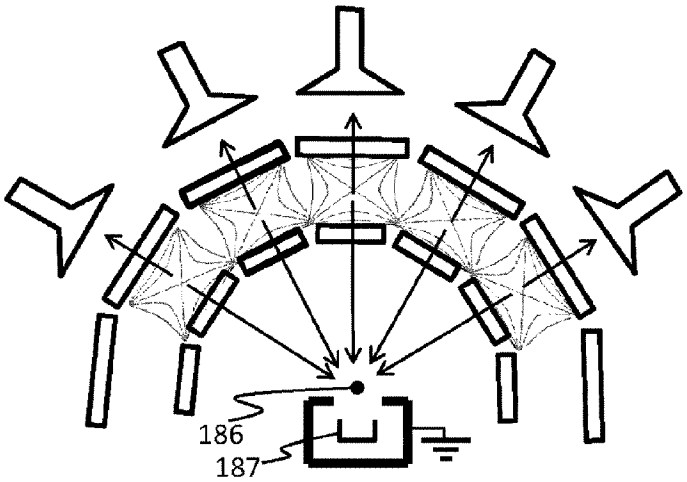

Another feature of the solution in FIG. 18D is that, symmetry planes where central axes of the units are located are designed to substantially intersect at a same axis 186, so that radial ejection directions of analysis units of multiple ion trapping apparatuses in the array are approximately focused in a small area, so as to reduce an area of a first collector in a multi-channel synchronous sampling working mode. This is advantageous when an ion current collection system uses a Faraday cylinder structure 187. Because the area of the collector is reduced, parasitic capacitance thereof is also reduced, which means that a low ion current can also obtain a great voltage signal response.

Figure 19B:
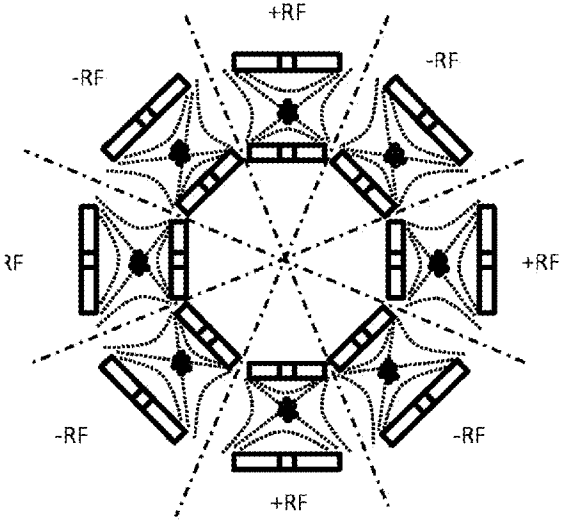
FIG. 19B is a structural diagram of an axial section and an internal electric field of a cylindrical ion trap array.
Figure 19A:
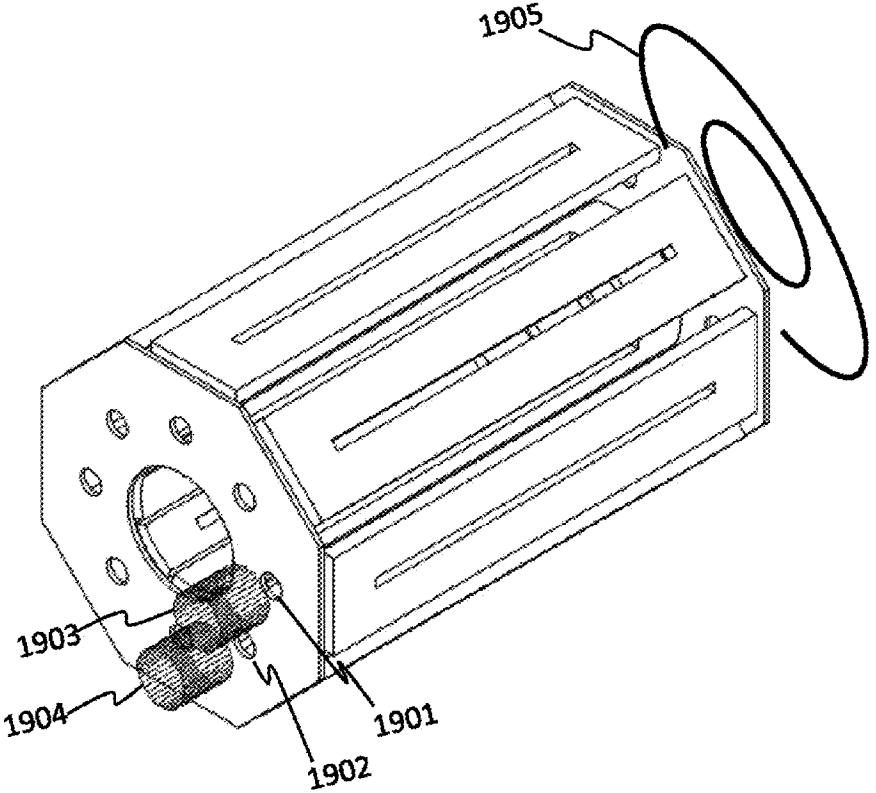
FIG. 19A is a three-dimensional structural diagram of a cylindrical ion trap array.
Figure 20B:
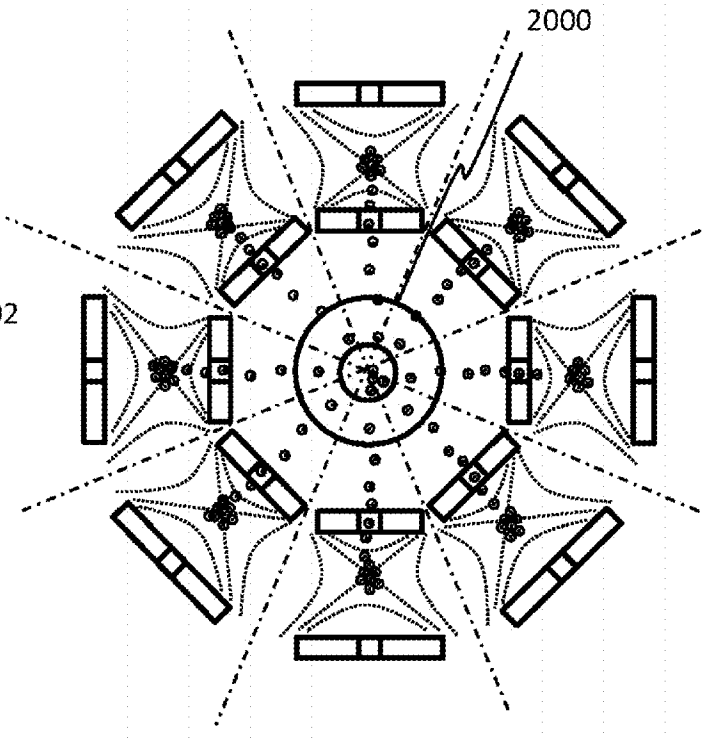
FIG. 20B is a schematic diagram of a cylindrical ion trap array detecting ion signals of all channels in parallel and synchronously by using a central detector.
Figure 20A:
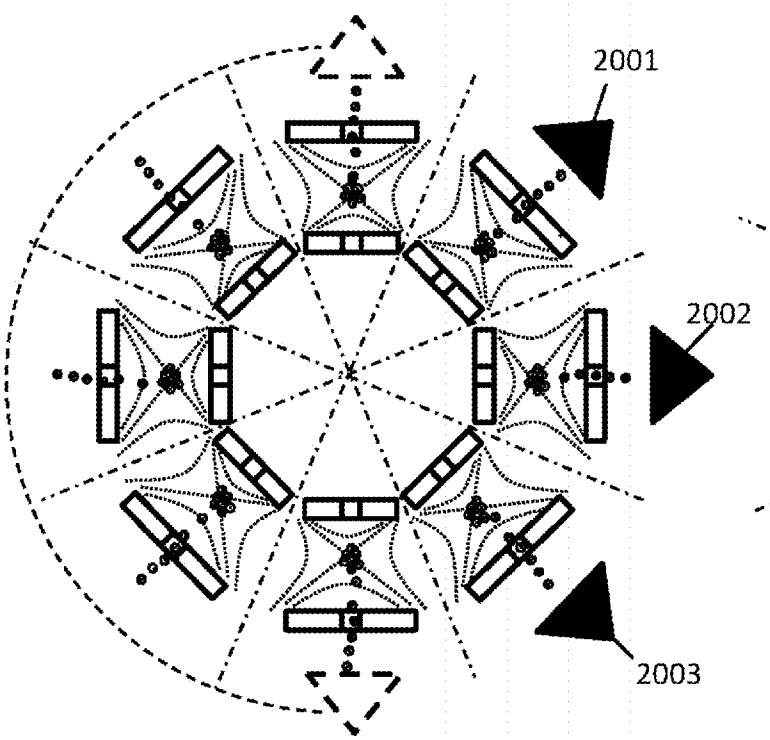
FIG. 20A is a schematic diagram of a cylindrical ion trap array detecting in a parallel manner an ion signal of each channel by using peripheral detectors of multiple channels.

FIG. 19A and FIG. 19B show a further preferred solution. In this solution, as compared with the solution shown in FIG. 18D, the ion trapping apparatus units in the array are distributed as a complete circle around the same axis, so that ions ejected from analysis units of multiple ion trapping apparatuses in the array are further focused on the central axis of the apparatus. Further, as shown in FIG. 20A and FIG. 20B, a common ion detector 2000 for detecting a total ion current of ions ejected by each branch ion trapping apparatus is disposed at the same axis. The detector may also be replaced by a first dynode on the axis, so that the body of the detector can be arranged at another appropriate position. A central ion detection system designed in this manner can be used to receive ejected ion currents focused at the central axis of the apparatus, and further enhance the ion currents before sending the ion currents to an analog-to-digital conversion collection apparatus. When the array of ion trapping apparatuses is long, ion ejection from the axis becomes difficult because the ejection electric field of the detector is shielded by electrodes of the array of ion trapping apparatuses, and in this case, bodies of multiple ion detectors or multiple first dynodes thereof may be arranged on the axis, where each ion detector correspondingly detects, in a certain range in the radial direction, ions that are ejected by each branch ion analysis unit along the radial direction. In addition, detectors such as 1903 and 1904 for ions ejected in the axial direction may also be disposed at extraction outlets 1901 and 1902 on each end cap, as shown in FIG. 19A and FIG. 19B. The axial mass-selective ejection principle proposed by Hager et al. is used to detect ions ejected by each ion analysis unit, or a microchannel plate 1905 with a large receiving area is used to detect all ions.

In the solution shown in FIG. 19A and FIG. 19B, the array generally should include 2N ion trapping apparatus units, because this solution is designed based on reusing at least a part of auxiliary electrodes as RF electrodes of an adjacent ion trapping apparatus unit. Therefore, as shown in FIG. 19B, RF voltages applied between adjacent units are generally inverted to each other. If the apparatus only includes an odd number of units, during synchronous mass spectrometry, there must be two adjacent units not involved each time, because in-phase RF signals are applied between RF electrodes thereof. Therefore, ions cannot be trapped and cooled effectively.

FIG. 20A and FIG. 20B further compare two basic working modes of the cylindrical ion trap mass analyzer array. In FIG. 20A, by means of phase adjustment of an excitation voltage, main ions to be analyzed are ejected toward multiple discrete channel detectors such as 2001, 2002, and 2003 on the external side, so that a monitored mass spectrum of each analysis unit is obtained. In FIG. 20B, by applying a DC voltage difference between an external electrode and an internal electrode, a balance saddle point of the quadrupole electric field of each unit of the ion trap moves toward the internal side, so that ions are ejected centripetally and gathered. The signal may be generally detected by a detector 2000 at the center of the cylindrical structure.

Figure 21B:
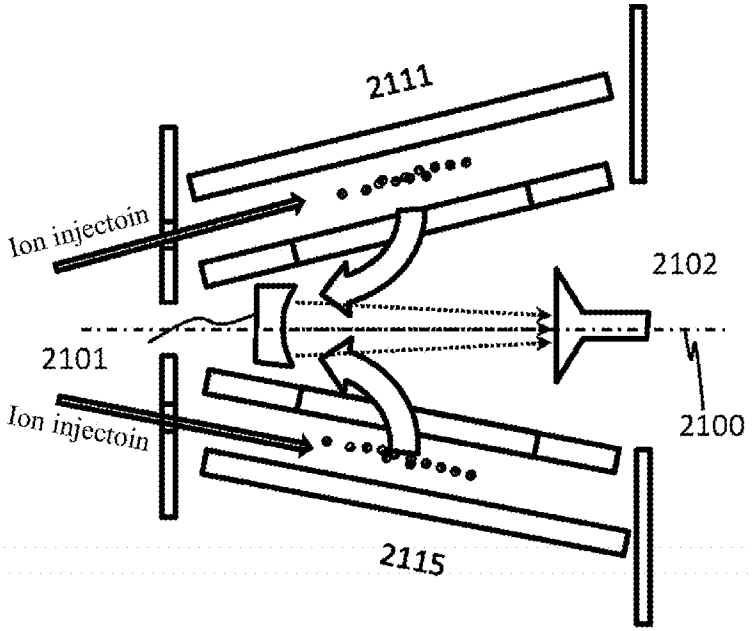
FIG. 21B is a sectional view of a principle of using a truncated-cone-shaped ion trap array and a coaxial detector component that includes a dynode in combination.
Figure 21A:
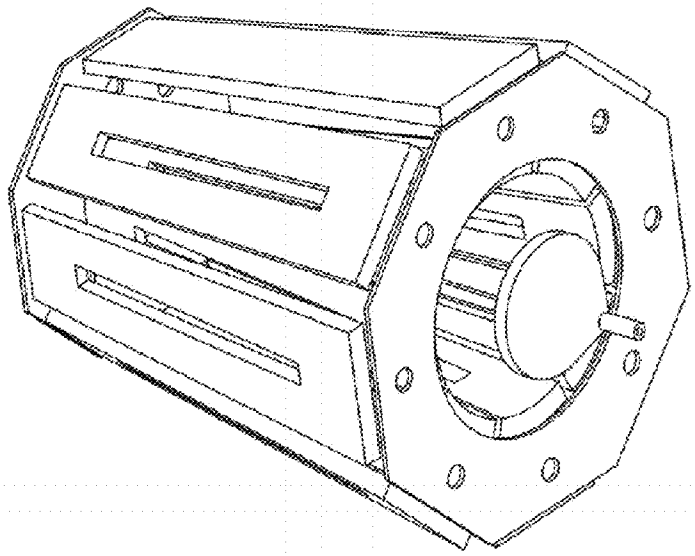
FIG. 21A is a three-dimensional structural diagram of a truncated-cone-shaped ion trap array and a detector component.

When the sample to be analyzed has high concentration, and the ion current from a preceding ion optical system needs to be split to each mass analysis unit for detection, a truncated-cone-shaped linear ion trapping apparatus array structure shown in FIG. 21A and FIG. 21B may be used, where central axes of ion trapping apparatus units such as 2111 and 2115, which are gathered at one end and divergent at the other end, are distributed in the form of a cone around the same axis 2100. Therefore, it is easier to introduce ions in a split manner from the same analysis ion source, and moreover, a larger space is reserved at the opening to facilitate the design of a shared detector structure, such as a coaxial dynode 2101 and a coaxial detector 2102 shown in FIG. 21B.

Figure 22:
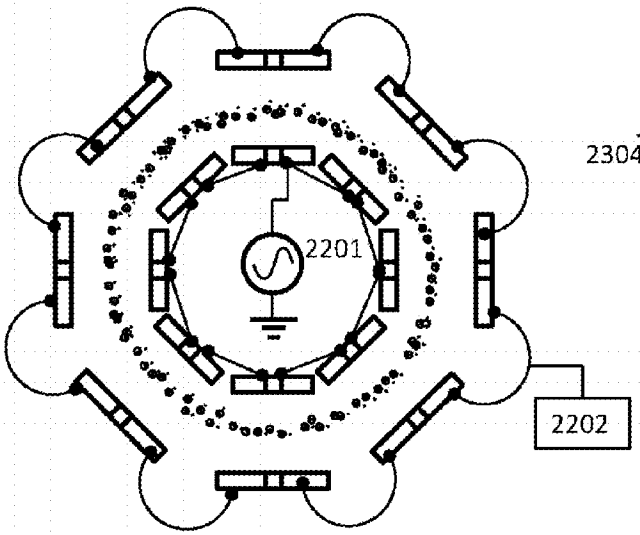
FIG. 22 describes, by using a cylindrical ion trap array as an example, how to convert the array into a large-scale substantial cylindrical ion trap that traps an internal ion cloud in a cylindrical manner by changing voltage configuration.

The cylindrical and truncated-cone-shaped ion trapping apparatus arrays described above further have another working mode. In this condition, as shown in FIG. 22, a power supply 2201 applies in-phase RF signals on all electrode arrays on the internal side, and a power supply 2202 applies compensation DC signal on electrode arrays on the external side; by means of the balance between the external side and internal side, the entire annular space is transformed into an ion storage apparatus with a super high capacity. It can be seen from the shape of the ion cloud presented on the cross section that, trapped ions are distributed in a cylindrical shape in the storage apparatus. When an accumulated ion flow needs to be detected, the RF signal on the external electrode array can be removed quickly, and a high-voltage pulse is applied to eject all ions at one time. This method can implement accurate intensity analysis on an ion current of which the mean intensity is lower than an electronic noise limit, and can also be combined with an ion mobility spectrometry method.

A common mass analyzer of an ion trapping apparatus type, namely, an ion trap mass analyzer, usually can work in a pulse mode only. When a preceding stage of the analyzer is a continuous ion current selection apparatus such as a quadrupole rod mass filter or a continuous differential selection ion mobility filter, the duty cycle of the series connection between the analyzer and the selection apparatus is undesirable, and generally, an extra ion current time modulation apparatus needs to disposed therebetween to obtain optimal time efficiency of the analysis process. However, the linear ion trapping apparatus in this solution has a high ion storage capacity; therefore, a high duty cycle of time utilized by ions can be achieved by using a mass-selective continuous ion storage method and a fast ion DC pulse ejection method, so as to match such continuous ion selection apparatus.

Figure 23:
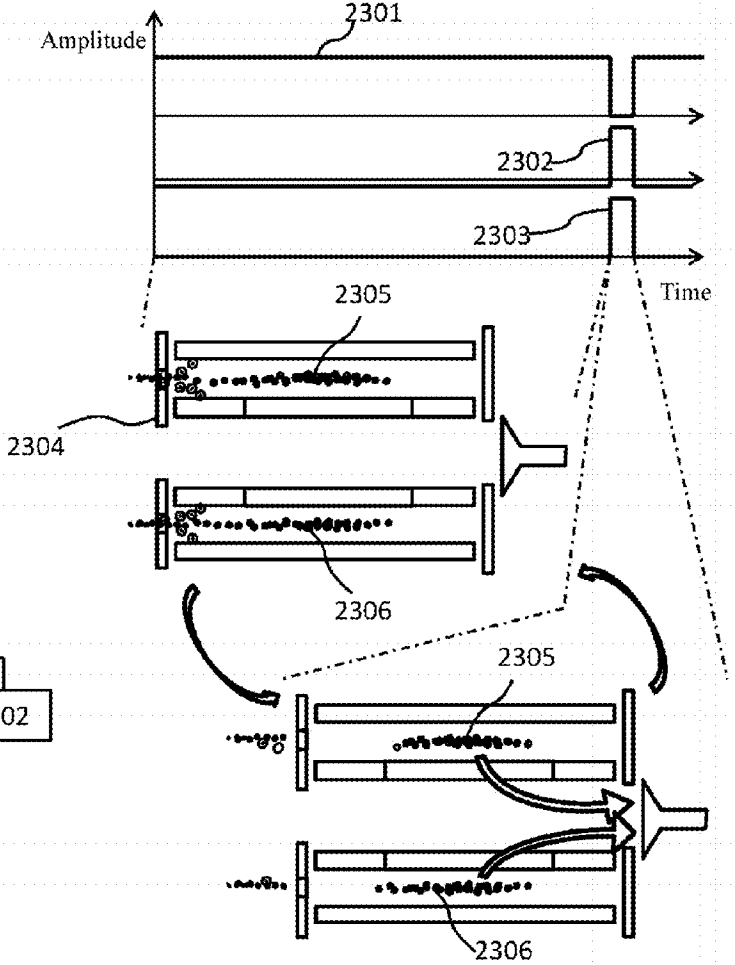
FIG. 23 is a time diagram of a principle for monitoring and analyzing, in an isolated storage-pulse ejection mode, selected ions among ions that are continuously introduced to an ion trapping apparatus array of an embodiment of the present invention via multiple channels.

FIG. 23 shows how to combine the two methods to analyze positive ion currents of multiple channels in the multi-channel linear ion trapping apparatus array of this embodiment. The time sequence of this working mode is divided into two stages. In a storage stage, a RF voltage 2301 applied on each channel is turned on, and at the same time, a threshold voltage 2302 of an ion gate 2304 is set to a low value, so that an ion current injected from the front end of the ion trapping apparatus to each channel in this stage can be injected to the ion trapping apparatus array. In this case, duty cycles of RF voltages on the ion trapping apparatus may be adjusted to asymmetric values. For example, for the ion trapping apparatus structure of which the internal quadrupole electric field component has high purity, when the trapping RF voltage has a square waveform and has a duty cycle of 38% to 39%, during ion introduction, only ions in a 5~10 Thomson mass window are stored, while other ions are discarded at the front end of the channel of the trapping apparatus. Similar to this manner, while ions are stored by using a symmetric waveform, a waveform including a continuous frequency spectrum and a frequency gap may be used to continuously excite ions not having the specific mass-to-charge ratio, so as to eliminate interference ions other than the target ion 2305, and achieve the objective of selective storage of an continuously injected ion current. Generally, this mode can achieve higher mass-isolated selectivity, but the speed is slow, and the operation period is of millisecond scale. By combining the two manners above, the isolated mass range required by the latter can be reduced by a high-speed wide mass isolation effect of the former, and the frequency spectrum width and the total time of the entire isolation process can be reduced.

After required ions are isolated successfully, this stage may be continued so that ions of the target mass or mass range are gathered in a certain channel, while ions of other target mass ranges may be gathered in other channels. When the total quantity of the trapped ions is close to 10% to 30% of the total storage limit of the trap, the RF voltage 2301 on each channel can be removed quickly, and simultaneously as shown in the second time sequence stage in FIG. 23, the threshold voltage 2302 of the ion gate 2304 is improved to close the injection passage of positive ions. At the same time or a few microseconds later, DC potential differences 2303 between the external group of RF and auxiliary electrodes and the internal group of RF and auxiliary electrodes are adjusted from 0 volt during original normal introduction trapping to a high voltage value exceeding the voltage of the RF power source, for example, 1000 V; that is, target ions 2305 stored in the previous stage may be ejected toward the center; an ion pulse is obtained at the detector, where the height or peak area of the ion pulse has a substantially linear relationship with target ions of the channel stored in the previous stage. Ions within the target mass range in the continuous ion current can be sampled at a sampling rate of 1 Hz to 1 KHz by repeating such two-stage process. Because ions are ejected by a pulse, the second time sequence stage only lasts several microseconds to dozens of microseconds. As compared with the millisecond-scale duration of the first time sequence stage, it can be seen that the time duty cycle of this method generally reaches over 99%. Similarly, target ions 2306 of identical or different mass ranges selected in other channels may also be stored and then detected using a pulse.

This method may also have a variation. In this mode, the trapping RF voltage 2301 in the second time sequence stage does not need to be reduced to 0. In this manner, when the ejection voltage difference 2303 is only applied between a pair of main RF electrodes of a certain channel, target ions stored in other channels are not lost. Therefore, pulse ejection analysis of different ion trapping channels can be distributed to different periods, and spectra of currents of ions with selected mass from multiple channels can be obtained by using only one detector. Apart from ion ejection by using a pulse, micro-area scanning may also be used, that is, resonance mass scanning is performed in a small mass range to obtain a spectrum of stored target ions. Compared with the pulse mode, in addition to obtaining the total amount of the target ions, the micro-area scanning mode can also be used for obtaining an abundance spectrum distribution of multiple mass numbers that are close to each other, and obtaining extra chemical information such as an isotope ratio.

Figure 24B:
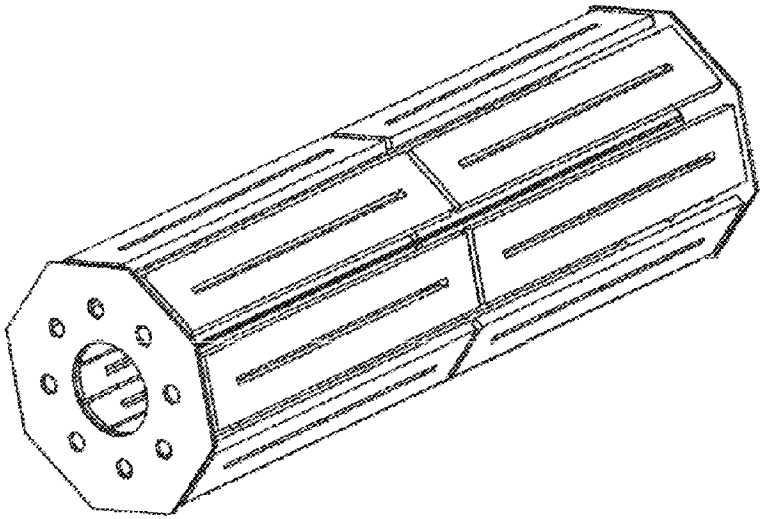
FIG. 24B is a three-dimensional diagram of a cylindrical ion trap two-dimensional array that is axially divided into two segments.
Figure 24A:
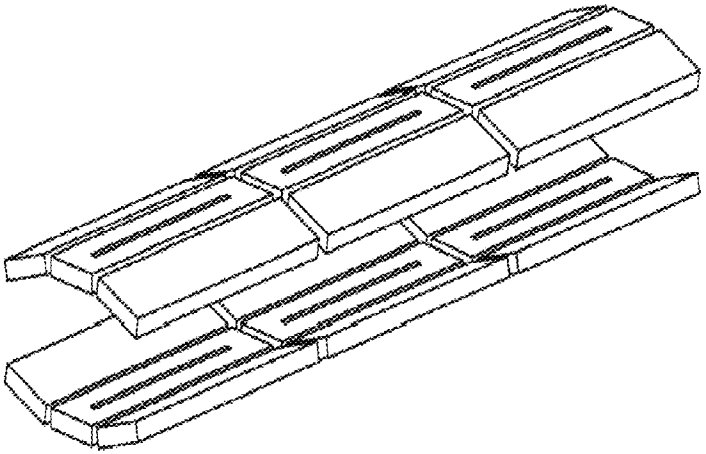
FIG. 24A is a three-dimensional diagram of a series linear ion trapping apparatus array that is axially divided into three segments and includes deflected auxiliary electrodes.

FIG. 24A and FIG. 24B show a larger axial series one-dimensional/two-dimensional array structure of this type of linear ion trapping apparatuses. FIG. 24A provides a basic trapping apparatus unit array having three segments connected in series in an axial direction, and FIG. 24B shows a two-segment two-dimensional array of tubular ion traps. In these array structures, positive and negative ions can be separately stored between different segments, and at an appropriate time, by setting voltages between axially adjacent segments to the same value, the positive and negative ions can be stored at the same time and react with each other. The apparatus may be used for studying a charge transfer and dissociation process and producing a fragment dissociation mode different from a common collision-induced dissociation process. In addition, ions may also be transferred between different segments, so that ions obtain an axial acceleration kinetic energy by means of a potential difference between segments, so as to obtain a tandem spectrum similar to that of a spatial tandem mass spectrometry apparatus such as a triple quadrupole rod instrument.

Figure 25B:
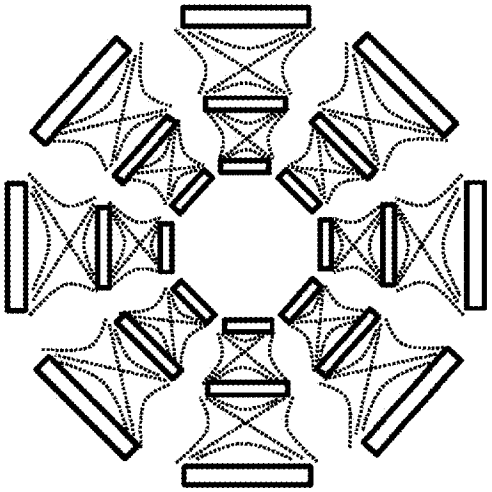
FIG. 25B is a sectional view of a cylindrical ion trap two-dimensional array that includes three layers of electrodes in an axial direction.
Figure 25A:
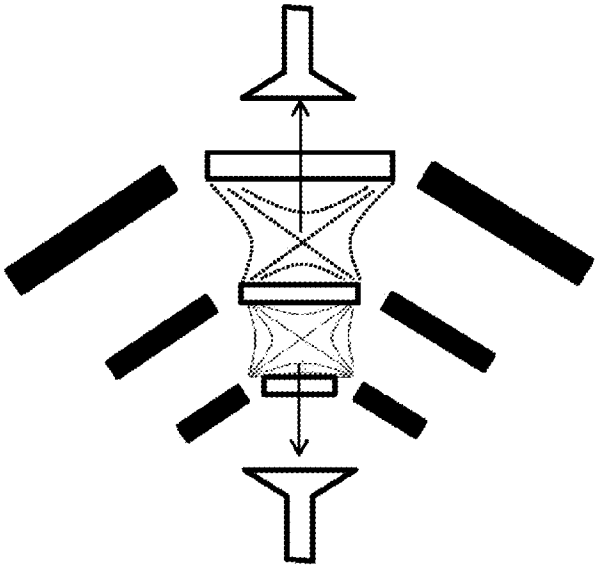
FIG. 25A is a sectional view of an asymmetric series linear ion trapping apparatus array that includes three layers of electrodes in an axial direction.

FIG. 25A and FIG. 25B separately show a cross section view of a one-dimensional/two-dimensional array structure of this type of linear ion trapping apparatuses overlaid in an axial direction. In such a structure, RF and auxiliary electrodes on this side are reused to form a multi-layer array of ion trapping apparatus units, where ions can be effectively stored between opposite RF electrodes in each layer, thereby further improving the ion storage capability of the apparatus.

Preferred embodiments of the present invention are described above, but are not intended to limit the present invention. Any person skilled in the art can make some modification and improvement without departing from the spirit and scope of the present invention. Therefore, the protection scope of the present invention shall be subject to the claims. For example, an upstream ion optical apparatus of the apparatus may be a continuous ion optical device such as an ion guider, a quadrupole rod mass analyzer and an array thereof, an ion funnel, a travelling wave transmission apparatus, a magnetic sector mass analyzer, a static sector energy analyzer or a differential mobility spectrum analyzer, and may also be a pulse optical device such as a pulse ion mobility spectrometer, or another ion trap. Apart from an electron multiplying tube, an electron multiplier including a dynode, a microchannel plate, a Faraday cylinder, the ion detector of the apparatus may also be another mass analyzer capable of receiving a pulse-type or substantial continuous ion current, such as a quadrupole rod, a single-round or multi-round time-of-flight (TOF) detector, a Fourier transform ion cyclotron resonance (FTICR) mass spectrometry, or a static ion trap (Orbitrap). Further, the ion analyzer not only may be coupled with liquid chromatography or a direct analysis method, but also may be coupled with capillary electrophoresis or gas chromatography. Ions analyzed not only may be from an ion source working in a vacuum condition, such as an electron bombardment source or a matrix-assisted laser desorption/ionization source, but also may be from an ion source under atmospheric pressure, such as an electrospray ionization source, an atmospheric pressure photo ionization source, or an atmospheric pressure chemical ionization source.

What is claimed is:

1. A linear ion trapping apparatus utilizing quadrupolar fields, comprising:

a pair of main RF electrodes that are oppositely disposed on two sides of a central axis of the linear ion trapping apparatus and extend along an axial direction, wherein cross section patterns, on all section planes perpendicular to the central axis, of each main RF electrode of the pair of main RF electrodes are symmetrical about a main symmetry plane that passes through the central axis, and phases of RF voltages applied on the pair of main RF electrodes are the same;

an ion ejection slot provided on at least one main RF electrode; and at least one pair of dual auxiliary electrodes is disposed such that at least one dual of the pair of electrodes is located on either side of the main symmetry plane and are symmetric about the main symmetry plane, wherein at least one auxiliary electrode of the dual has a non-zero and finite number of auxiliary symmetry planes, wherein the auxiliary symmetry planes are symmetry planes of the at least one auxiliary electrode, wherein when each of the auxiliary planes when intersecting the main symmetry plane do so such that the included angle is between 0 and 30 degrees.

2. The linear ion trapping apparatus according to claim 1, comprising two auxiliary electrode pairs disposed as duals with the main symmetry plane.

3. The linear ion trapping apparatus according to claim 1, wherein the central axis is a curve in the main symmetry plane of the pair of main RF electrodes.

4. The linear ion trapping apparatus according to claim 1, wherein, the ion ejection slot is formed by a gap between components of the pair of main RF electrodes symmetrical about the main symmetry plane.

5. The linear ion trapping apparatus according to claim 1, wherein, the linear ion trapping apparatus is symmetrical about a plane that passes through the central axis and is perpendicular to the main symmetry plane.

6. The linear ion trapping apparatus according to claim 1, wherein the linear ion trapping apparatus has no other symmetry planes in a direction perpendicular to the main symmetry plane.

7. The linear ion trapping apparatus according to claim 1, wherein a transient resting potential distribution of the linear ion trapping apparatus on a cross section perpendicular to the central axis has asymmetric components dominated by a hexapole field in series expansion terms of a harmonic function with an electric field saddle point as a center, and an absolute value of a component factor ratio of the hexapole field to a quadrupole field is between 0.5% and 10%.

8. The linear ion trapping apparatus according to claim 1, wherein an electric field saddle point center of the linear ion trapping apparatus is deviated relative to a middle position of the pair of main RF electrodes toward one side, and the deviation accounts for 0.5% to 20% of a field radius of the ion trapping apparatus.

9. The linear ion trapping apparatus according to claim 1, wherein, the deviation accounts for 0.5% to 10% of the field radius of the ion trapping apparatus.

10. The linear ion trapping apparatus according to claim 1, further comprising two end electrode structures used for reflecting ions, and disposed at two ends of the linear ion trapping apparatus along the central axis.

11. The linear ion trapping apparatus according to claim 1, wherein at least one of the main RF electrodes or the auxiliary electrodes has a planar electrode structure, or a thin-layer electrode structure attached on an insulator plane.

12. The linear ion trapping apparatus according to claim 1, wherein in the even-numbered pairs of auxiliary electrodes, a structure of each auxiliary electrode is the same as that of a main RF electrode on the same side of the central axis.

13. The linear ion trapping apparatus according to claim 1, further comprising:

a working power supply; and an adjustment apparatus, used for adjusting an amplitude ratio of RF voltages or bias DCs applied between the pair of main RF electrodes and the auxiliary electrode, and changing a dominant ejection direction in a mass scanning process accordingly.

14. The linear ion trapping apparatus according to claim 1, further comprising:

a field adjustment electrode, located at one end of the ion trapping apparatus along the central axis, and symmetrical about the main symmetry plane; and a power supply, used for applying a pure DC bias voltage on the field adjustment electrode, or applying, on the field adjustment electrode, a DC bias voltage on the basis of a RF trapping voltage applied on a main RF electrode adjacent to the field adjustment electrode, so as to adjust a dominant ejection direction or improve mass resolution during a mass scanning process.

15. A mass spectrometry method, comprising the following steps:

using at least one linear ion trapping apparatus according to claim 1 to trap target ions; and using the following means to adjust a mass axis shift of trapped target ions or a product of trapped target ions in a mass-selective ejection process: adjusting an amplitude ratio of RF voltages or bias DCs applied between the main RF electrodes and the auxiliary electrode.

16. A mass spectrometry method, comprising the following steps:

using at least one linear ion trapping apparatus according to claim 13 to trap target ions; and using the following means to adjust a mass axis shift of trapped target ions or a product of trapped target ions in a mass-selective ejection process: adjusting an amplitude of a bias DC voltage applied on the field adjustment electrode.

17. A linear ion trapping apparatus array structure, comprising:

multiple linear ion trapping apparatuses according to claim 1, wherein at least a part of auxiliary electrodes are reused between adjacent linear ion trapping apparatuses.

18. The linear ion trapping apparatus array structure according to claim 17, wherein the at least a part of auxiliary electrodes reused are also main RF electrodes of an adjacent linear ion trapping apparatus.

19. The linear ion trapping apparatus array structure according to claim 18, wherein at an external side of a linear ion trapping apparatus, the linear ion trapping apparatus is duplicated periodically in a direction perpendicular to the main symmetry plane, so as to form an ion trapping apparatus unit array.

20. The linear ion trapping apparatus array structure according to claim 17, wherein main symmetry planes where central axes of the linear ion trapping apparatuses are located substantially intersect at a same axis.

21. The linear ion trapping apparatus array structure according to claim 18, wherein, the linear ion trapping apparatuses are circumferentially distributed around the same axis.

22. The linear ion trapping apparatus array structure according to claim 18, wherein the central axes of the linear ion trapping apparatuses are distributed around the same axis in the form of a cone-dispersion, and the central axes are gathered at one end, and divergent at the other end.

23. The linear ion trapping apparatus array structure according to claim 18, wherein at an external side of a linear ion trapping apparatus, along the central axis, a multi-layer ion trapping apparatus unit array is formed by reusing the main RF electrodes and auxiliary electrodes.

24. The linear ion trapping apparatus array structure according to claim 17, wherein the linear ion trapping apparatus array structure is an ion mass analyzer capable of temporally or spatially separating ions with different mass-to-charge ratios.

25. The linear ion trapping apparatus array structure according to claim 17, wherein the linear ion trapping apparatus array structure is a linear ion trap mass analyzer.

26. A ion analysis and detection apparatus, comprising:

the linear ion trapping apparatus array structure according to claim 20; and a common ion detector on the same axis and for at least one primary ion contact surface provided on the same axis.

27. A mass spectrometry method, comprising the following steps:

using at least one linear ion trapping apparatus according to claim 1 to trap ions;

applying, on the main RF electrodes, trapping RF voltages having a frequency of 5 KHz to 20 MHz and having the same phase;

applying, on each auxiliary electrode, an auxiliary DC or RF voltage used for adjusting a quadrupole electric field component and a multi-pole electric field component between the main RF electrodes;

scanning an amplitude or a frequency of the trapping RF voltage applied on the main RF electrodes, so that ions in one or more ions mass-to-charge ratio ranges leave a storage space of the linear ion trapping apparatus;

making at least a part of ions remaining in the linear ion trapping apparatus leave the linear ion trapping apparatus; and detecting, by using a detector, ions that leave the linear ion trapping apparatus in at least a part of time periods, so as to obtain an electric signal that changes according to ejection time and represents a mass spectrum signal of ions in at least a part of mass-to-charge ratio ranges of the trapped target ions.

28. The mass spectrometry method according to claim 27, wherein ions are trapped by using an array structure formed by multiple linear ion trapping apparatuses, and a combination of electric signals that are obtained by at least one of the linear ion trapping apparatuses and represent mass spectrum signals is used to form a mass spectrum signal.

* * * * *